US005500331A

United States Patent [19]

Czekai et al.

[11] Patent Number: 5,500,331

[45] Date of Patent: * Mar. 19, 1996

[54] COMMINUTION WITH SMALL PARTICLE MILLING MEDIA

[75] Inventors: David A. Czekai, Honeoye Falls; Larry P. Seaman, Mt. Morris, both of N.Y.

[73] Assignee: Eastman Kodak Company, Rochester, N.Y.

[ * ] Notice: The portion of the term of this patent subsequent to Dec. 26, 2012, has been disclaimed.

[21] Appl. No.: 248,774

[22] Filed: May 25, 1994

[51] Int. Cl.[6] ..... G03C 1/00; B02C 17/20

[52] U.S. Cl. ..... 430/449; 430/546; 430/377; 430/631; 241/184

[58] Field of Search ..... 430/546, 377, 430/449, 631; 241/184

[56] References Cited

U.S. PATENT DOCUMENTS

| | | | |
|---|---|---|---|
| 3,104,608 | 9/1963 | Castelll et al. | 241/16 |
| 3,713,593 | 1/1973 | Morris et al. | 241/184 |
| 4,262,851 | 4/1981 | Graser et al. | 241/184 |
| 4,404,346 | 9/1983 | Pirotta et al. | 521/29 |
| 4,474,872 | 10/1984 | Onishi et al. | 430/546 |
| 4,940,654 | 7/1990 | Diehl et al. | 430/522 |
| 4,974,368 | 12/1990 | Miyamoto et al. | 51/55 |
| 5,066,335 | 11/1991 | Lane et al. | 134/7 |
| 5,066,486 | 11/1991 | Kamen et al. | 424/63 |
| 5,145,684 | 9/1992 | Liversidge et al. | 429/489 |

FOREIGN PATENT DOCUMENTS 498482 8/1992 European Pat. Off. .

OTHER PUBLICATIONS

Drukenbrod, "Smaller is Better?", Paint & Coatings Industry, Dec. 1991, p. 18.

*Primary Examiner*—Charles L. Bowers, Jr.
*Assistant Examiner*—Mark F. Huff
*Attorney, Agent, or Firm*—Andrew J. Anderson

[57] ABSTRACT

A method of preparing submicron particles of a material, such as a pigment useful in paints or a compound useful in imaging elements, which comprises milling the agent in the presence of milling media having a mean particle size of less than about 100 microns. In a preferred embodiment, the milling media is a polymeric resin. The method provides extremely fine particles, e.g., less than 100 nm in size, free of unacceptable contamination.

11 Claims, 15 Drawing Sheets

COMMINUTION WITH SMALL PARTICLE MILLING MEDIA

FIELD OF THE INVENTION

This invention relates to milling material using small particle milling media. In particular, it relates to milling compounds useful in imaging elements using small particle milling media.

BACKGROUND OF THE INVENTION

Over the last ten years there has been a transition to the use of small milling media in conventional media mill processes for the preparation of various paints, pigment dispersions and photgraphic (and other imaging) dispersions. This transition has been made possible due primarily to the improvements in media mill designs (eg. Netzsch LMC mills and Drais DCP mills) which allow the use of media as small as 250 microns (μm). The advantages of small media include more efficient comminution (ie. faster rates of size reduction) and smaller ultimate particle sizes.

Even with the best machine designs available, it is generally not possible to use media smaller than 250 μm due to separator screen plugging and unacceptable pressure build-up due to hydraulic packing of the media. In fact, for most commercial applications, 350 μm media is considered the practical lower limit for most systems. Little or no consideration has been given to further exploit possible advantages of using media smaller than 250 μm.

PROBLEM TO BE SOLVED BY THE INVENTION

In many photographic and and other imaging applications, dispersion particle sizes as small as 100 nanometers (nm) are easily attainable with conventional media mills using media 350 mm and larger. However, it is highly desirable to produce dispersion particle sizes much smaller than 100 nm. Advantages of further size reduction may include improved performance of photographic addenda such as filter dyes, sensitizing dyes, antifoggants and image forming couplers.

SUMMARY OF THE INVENTION

We have discovered that extremely fine particles, e.g., of a size less than 100 nm, of a compound useful in imaging elements can be prepared by milling in the presence of milling media having a mean particle size of less than about 100 microns. Further, the particles obtained are substantially free of unacceptable contamination.

More specifically, in accordance with this invention, there is provided a method of preparing particles of a compound useful in imaging elements which comprises milling the agent in the presence of grinding media having a mean particle size of less than about 100 μm.

ADVANTAGEOUS EFFECT OF THE INVENTION

It is a particularly advantageous feature of this invention that there is provided a method of preparing extremely fine particles of a compound useful in imaging elements free of unacceptable contamination and/or discoloration.

Still another advantageous feature of this invention is that there is provided a method of milling compounds useful in imaging elements to obtain extremely fine particles, which method generates less heat and reduces potential heat related problems such as chemical instability and contamination.

It is another advantageous feature of this invention that a method of milling compounds useful in imaging elements to obtain extremely fine particles thereof, wherein the method enables improved pH control.

DETAILED DESCRIPTION OF THE INVENTION

Figure 1:
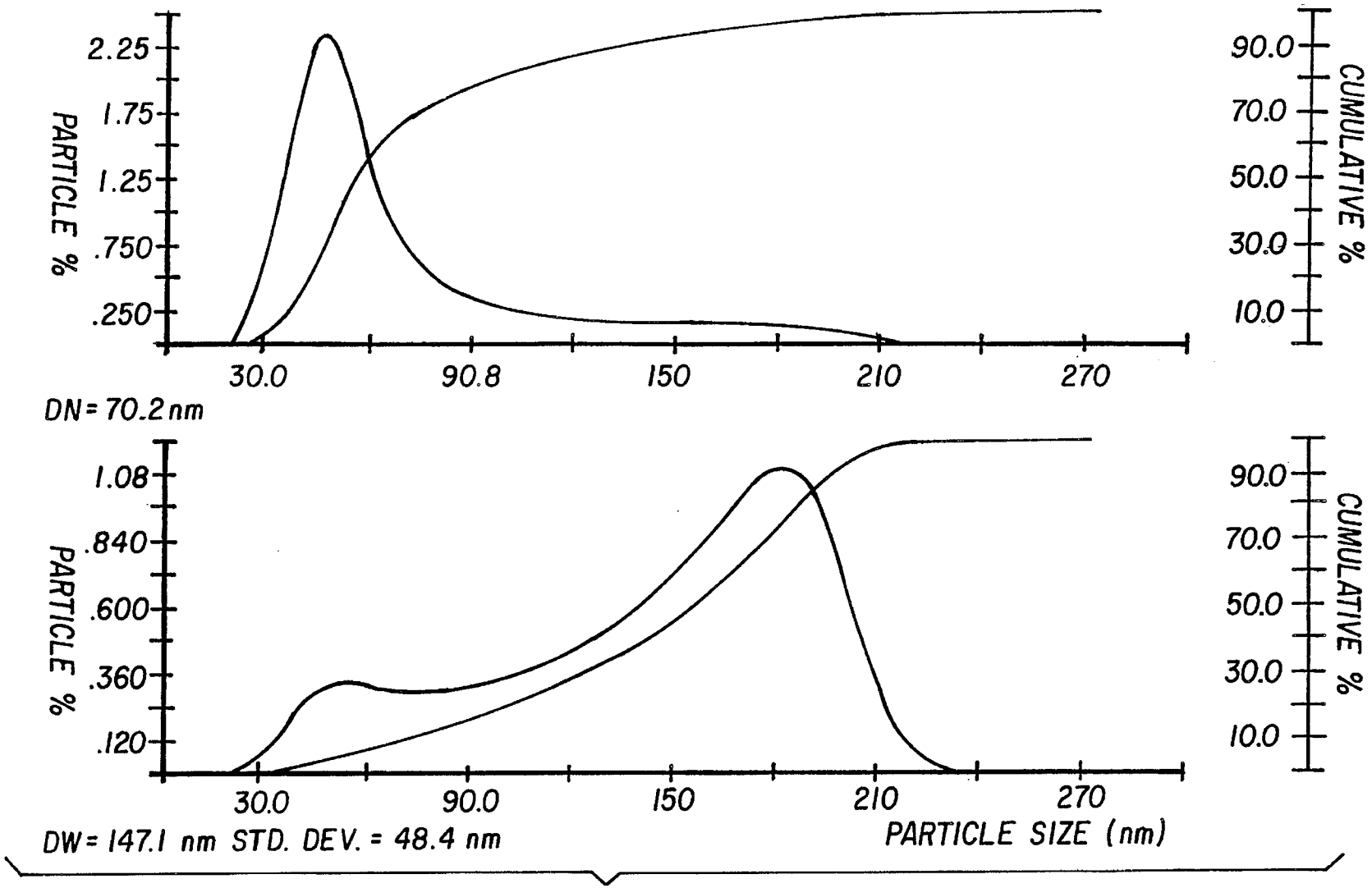
FIGS. 1 through 15 are graphs presenting the data obtained in the examples set forth below.

This invention is based partly on the discovery that materials, such as pigments for paints and compounds useful in imaging elements, can be prepared in extremely fine particles by the use of milling media having a particle size less than about 100 μm. The term "compounds useful in imaging elements" refers to compounds that can be used in photographic elements, electrophotographic elements, thermal transfer elements, and the like. While this invention is described primarily in terms of its application to compounds useful in imaging, it is to be understood that the invention can be applied to a wide variety of materials.

In the method of this invention, a compound useful in imaging elements is prepared in the form of submicron particles by milling the compound in the presence of a milling media having a mean particle size of less than about 100 microns.

In a preferred embodiment, the grinding media can comprise particles, preferably substantially spherical in shape, e.g., beads, consisting essentially of a polymeric resin.

In general, polymeric resins suitable for use herein are chemically and physically inert, substantially free of metals, solvent and monomers, and of sufficient hardness and friability to enable them to avoid being chipped or crushed during milling. Suitable polymeric resins include crosslinked polystyrenes, such as polystyrene crosslinked with divinylbenzene, styrene copolymers, polyacrylates such as polymethyl methylacrylate, polycarbonates, polyacetals, such as Derlin™, vinyl chloride polymers and copolymers, polyurethanes, polyamides, poly(tetrafluoroethylenes), e.g., Teflon™, and other flouropolymers, high density polyethylenes, polypropylenes, cellulose ethers and esters such as cellulose acetate, polyhydroxymethacrylate, polyhydroxyethyt acrylate, silicone containing polymers such as polysiloxanes and the like. The polymer can be biodegradable. Exemplary biodegradable polymers include poly(lactides), poly(glycolids) copolymers of lactides and glycolide, polyanhydrides, poly(hydroxyethyl methacrylate), poly(imino carbonates), poly(N-acylhydroxyproline) esters, poly(N-palmitoyl hydroxyprolino)esters, ethylene-vinyl acetate copolymers, poly(orthoesters), poly(caprolactones), and poly(phosphazenes).

The polymeric resin can have a density from 0.9 to 3.0 g/cm$^3$. Higher density resins are preferred inasmuch as it is believed that these provide more efficient particle size reduction.

Furthermore, Applicants believe that the invention can be practiced in conjunction with various inorganic milling media prepared in the appropriate particle size. Such media include zirconium oxide, such as 95% ZrO stabilized with magnesia, zirconium silicate, glass, stainless steel, titania, alumina, and 95% Zro stabilized with yttrium.

The media can range in size up to about 100 microns. For fine grinding, the particles preferably are less than about 90 microns, more preferably, less than about 75 microns in size and most preferably less that about 50 microns. Excellent particle size reduction has been achieved with media having a particle size of about 25 microns, Media milling with media having a particle size of 5 microns or less is contemplated.

The milling process can be a dry process, e.g., a dry roller milling process, or a wet process, i.e., wet-milling. In preferred embodiments, this invention is practiced in accordance with the wet-milling process described in U.S. Pat. No. 5,145,684 and European Patent Application 498,492, the disclosures of which are incorporated herein by reference. Thus, the wet milling process can be practiced in conjunction with a liquid dispersion medium and surface modifier such as described in these publications. Useful liquid dispersion media include water, aqueous salt solutions, ethanol, butanol, hexane, glycol and the like. The surface modifier can be selected from known organic and inorganic materials such as described in these publications. The surface modifier can be present in an amount 0.1–90%, preferably 1–80% by weight based on the total weight of the dry particles.

In preferred embodiments, the compound useful in imaging elements can be prepared in submicron or nanoparticulate particle size, e.g., less than about 500 nm. Applicants have demonstrated that particles having an average particle size of less than 100 nm have been prepared in accordance with the present invention. It was particularly surprising and unexpected that such fine particles could be prepared free of unacceptable contamination.

Milling can take place in any suitable grinding mill. Suitable mills include an airier mill, a roller mill, a ball mill, an attritor mill, a vibratory mill, a planetary mill, a sand mill and a bead mill. A high energy media mill is preferred when the grinding media consists essentially of the polymeric resin. The mill can contain a rotating shaft.

The preferred proportions of the milling media, the compound useful in imaging, the optional liquid dispersion medium and surface modifier can vary within wide limits and depends, for example, upon the particular material selected, the size and density of the milling media, the type of mill selected, etc. The process can be carried out in a continuous, batch or semi-batch mode. Such process comprise, for example:

Batch Milling

A slurry of milling media, <100 μm, liquid, active material (i.e.,material to reduced to sub-micron size dispersed in the liquid and stabilized by the stabilizer) and stabilizer is prepared using simple mixing. This slurry may be milled in conventional high energy batch milling processes such as high speed attritor mills, vibratory mills, ball mills, etc. This slurry is milled for a predetermined length of time to allow comminution of the active material to a minimum particle size. After milling is complete, the dispersion of active material is separated from the grinding media by a simple sieving or filtration.

Continuous Media Recirculation Milling

A slurry of <100 μm milling media, liquid, active material and stabilizer as indicated above may be continuously recirculated from a holding vessel through a conventional media mill which has a media separator screen adjusted to >100 μm to allow free passage of the media throughout the circuit. After milling is complete, the dispersion of active material is separated from the grinding media by simple sieving or filtration.

Mixed Media Milling

A slurry of <100 μm milling media, liquid, active material and stabilizer as indicated above may be continuously recirculated from a holding vessel through a conventional media mill containing milling media >250 mm. This mill should have a screen separator to retain the large media in the milling chamber while allowing passage of the small media through the milling chamber. After milling is complete, the dispersion of active material is separated from the grinding media by simple sieving or filtration.

In high energy media mills, it frequently is desirable to leave the milling vessel up to half filled with air, the remaining volume comprising the milling media and the liquid dispersion media, if present. This permits a cascading effect within the vessel on the rollers which permits efficient milling. However, when foaming is a problem during wet milling, the vessel can be completely filled with the liquid dispersion medium.

The attrition time can vary widely and depends primarily upon the particular compound useful in imaging (or other material), mechanical means and residence conditions selected, the initial and desired final particle size and so forth. For ball mills, processing times from several days to weeks may be required. On the other hand, residence times of less than about 8 hours are generally required using high energy media mills.

After attrition is completed, the milling media is separated from the milled particulate product (in either a dry or liquid dispersion form) using conventional separation techniques, such as by filtration, sieving through a mesh screen, and the like.

The process can be practiced with a wide variety of materials, in particular pigments useful in paints and especially compounds useful in imaging elements. In the case of dry milling the compound useful in imaging elements should be capable of being formed into solid particles. In the case of wet milling the compound useful in imaging elements should be poorly soluble and dispersible in at least one liquid medium. By "poorly soluble", it is meant that the compound useful in imaging elements has a solubility in the liquid dispersion medium, e.g., water, of less that about 10 mg/ml, and preferably of less than about 1 mg/ml. The preferred liquid dispersion medium is water. additionally, the invention can be practiced with other liquid media.

In preferred embodiments of the invention the compound useful in imaging elements is dispersed in water and the resulting dispersion is used in the preparation of the imaging element. The liquid dispersion medium comprises water and a surfactant. The surfactant used can be, for example, a polymeric dispersing aid described in copending applications Ser. Nos. 228,839, 228,971, and 229,267 all filed on April 18, 1994 the disclosures of which are incorporated herein by reference. Other surfactants that can be used include:

SURF 1
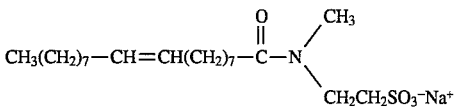
SURF 2
a mixture of:
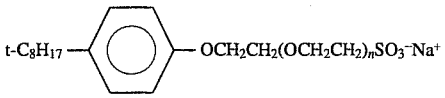
and n = 1–3
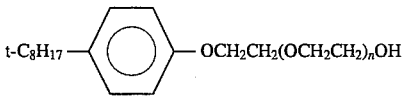
SURF 3
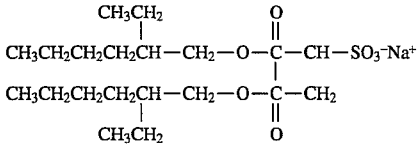
SURF 4
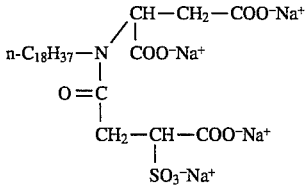
SURF 5
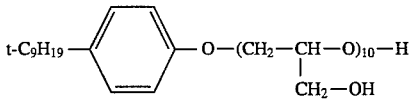
SURF 6
SURF 7
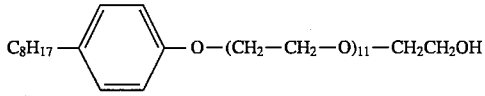
SURF 8
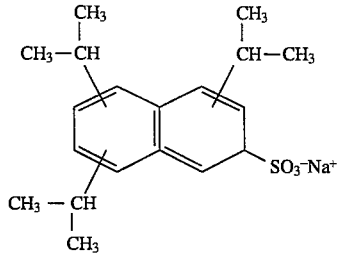
SURF 9
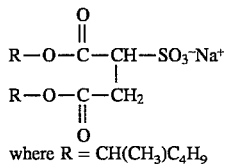
where R = $CH(CH_3)C_4H_9$
SURF 10
where R = 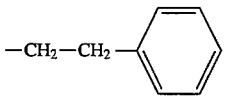
SURF 11
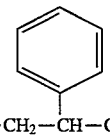
where R = $-CH_2-CH-CH_3$ -continued
where R = $-CH_2-CH(CH_2CH_3)C_3H_7$ SURF 12
where R = $-(CH_2)_nCH_3$(n = 2, 3 & 5) SURF 13
SURF 14
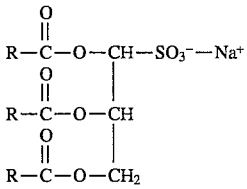
where R = $-(CH_2)_n-$ 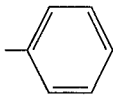 (n = 2–5)
$n\text{-}C_{12}H_{25}-O-(CH_2-CH_2-O)_{22}-CH_2CH_2OH$ SURF 15
$C_{12}H_{25}-O-(CH_2-CH_2-O)_{15}-CH_2$ SURF 16
$CH_2-SO_3^-Na^+$
SURF 17
$n\text{-}C_{12}H_{25}-O-(CH_2-CH_2-O)_n-C(=O)-CH_2-SO_3^-Na^+$
$CH_2-COO^-Na^+$
n = 3–5
SURF 18
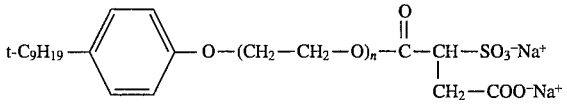
n = 5–10
SURF 19
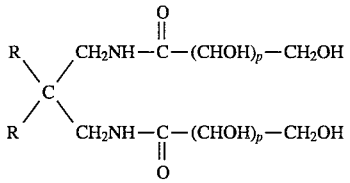
where p = 3 to 10
where, R = $n\text{-}CH_3-(CH_2)_x-$ (where x = 3–10) SURF 20
SURF 21
where R = 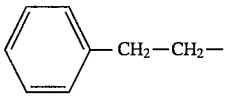 $-CH_2-CH_2-$
SURF 22
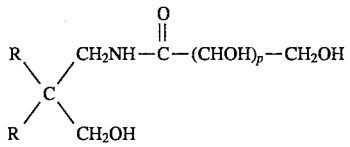
where, R = $n\text{-}CH_3-(CH_2)_x-$
(where x = 3 to 10
p = 3 to 15)
R = 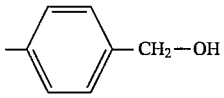 $-CH_2-OH$ -continued
SURF 23
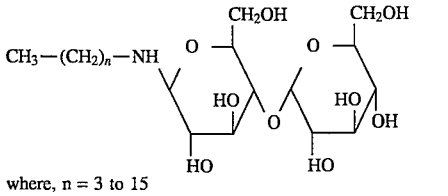
where, n = 3 to 15
SURF 24
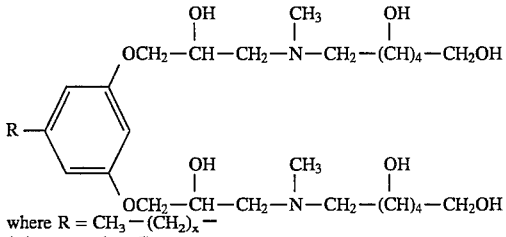
where R = $CH_3-(CH_2)_x-$
(where, x = 1 to 5)
SURF 25
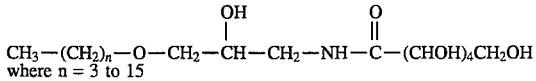
where n = 3 to 15
SURF 26
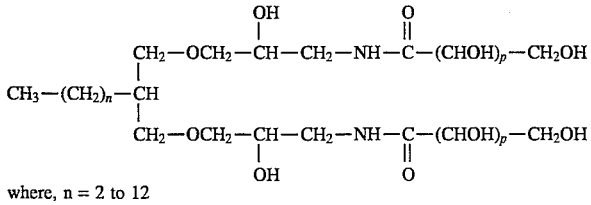
where, n = 2 to 12
p = 3 to 10
SURF 27
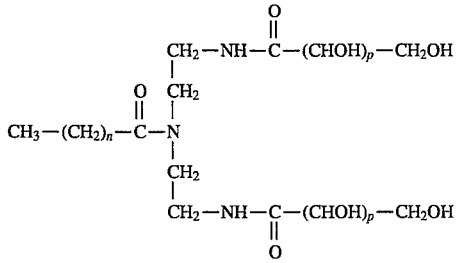
where, n = 2 to 18
p = 3 to 10
SURF 28
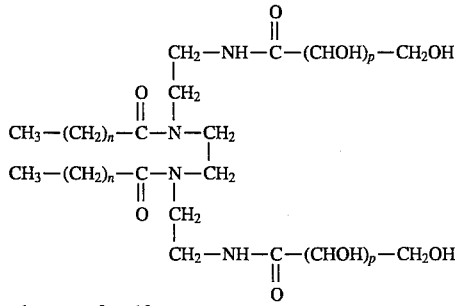
where, n = 2 to 18
p = 3 to 10
SURF 29
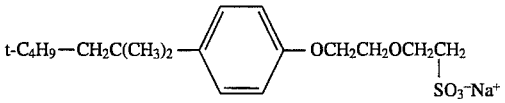
SURF 30
$CH_3-(CH_2)_{11}-SO_4^-Na^+$
SURF 31
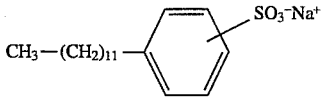

Suitable compounds useful in imaging elements include for example, dye-forming couplers, development inhibitor release couplers (DIR's), development inhibitor anchimeric release couplers (DI(A)R's), masking couplers, filter dyes, thermal transfer dyes, optical brighteners, nucleators, development accelerators, oxidized developer scavengers, ultraviolet radiation absorbing compounds, sensitizing dyes, development inhibitors, antifoggants, bleach accelerators, magnetic particles, lubricants, matting agents, etc.

Examples of such compounds can be found in Research Disclosure, December 1989, Item 308,119 published by Kenneth Mason Publications, Ltd., Dudley Annex, 12a North Street, Emsworth, Hampshire P010 7DQ, England, Sections VII and VIII, which are incorporated herein by reference, and in Research Disclosure, November 1992, Item 34390 also published by Kenneth Mason Publications and incorporated herein by reference.

Preferred compounds useful in imaging elements that can be used in dispersions in accordance with this invention are filter dyes, thermal transfer dyes, and sensitizing dyes, such as those described below.

D-1

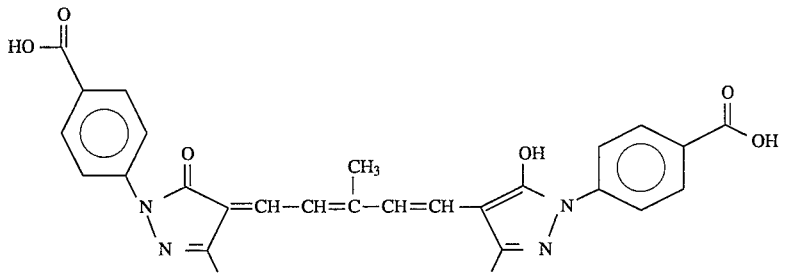

D-2

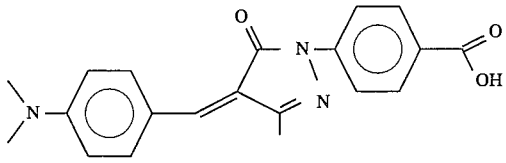

D-3

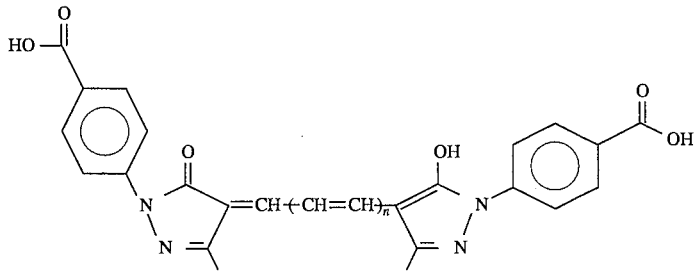

(n = 0)

D-4

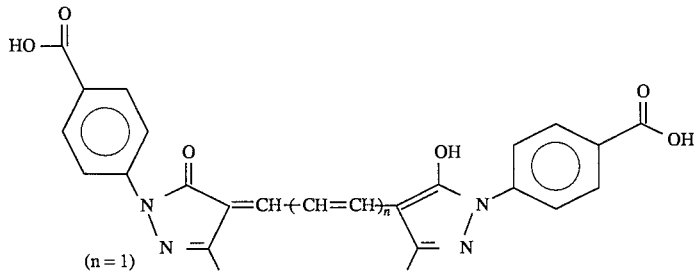

(n = 1)

D-5

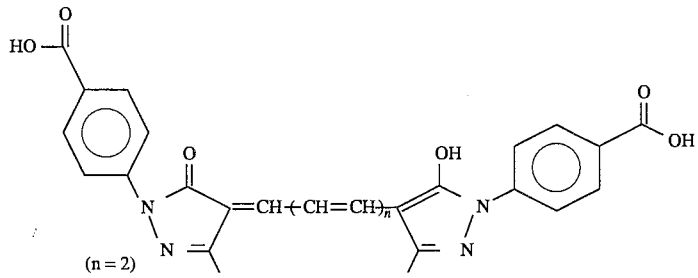

(n = 2)

-continued
D-6
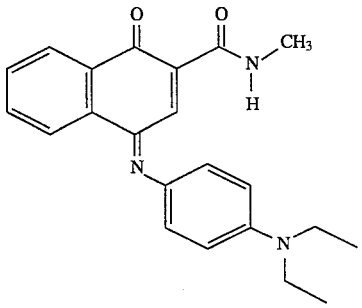
D-7
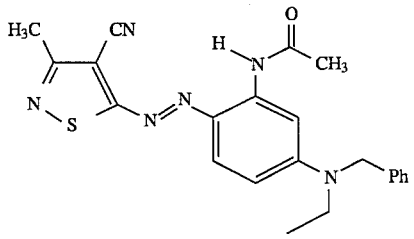
D-8
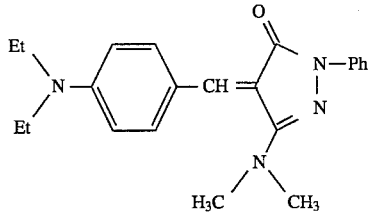
D-9
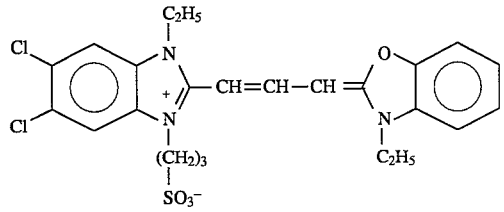
D-10
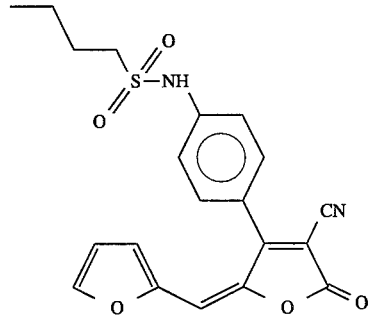
D-11
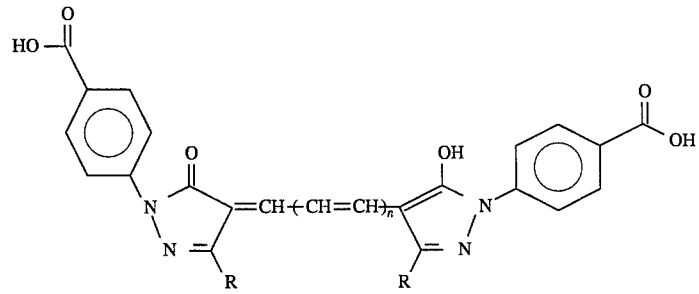
n = 0–2, R = c2–c10 alkyl, aryl -continued
D-12
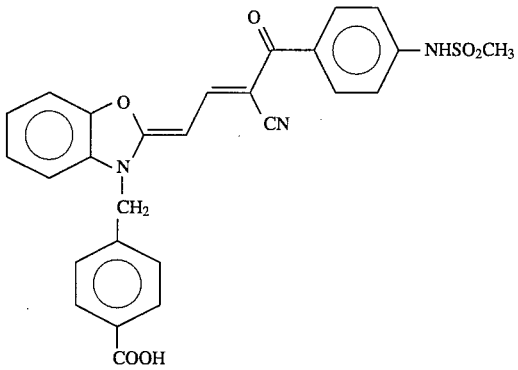
D-13
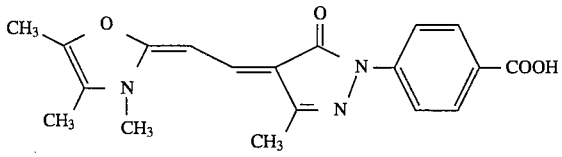
D-14
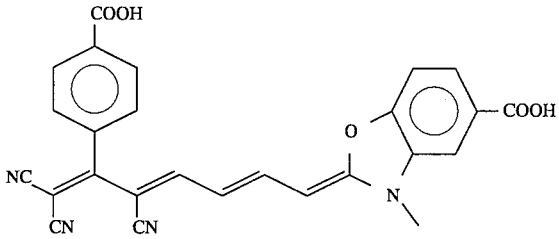
D-15
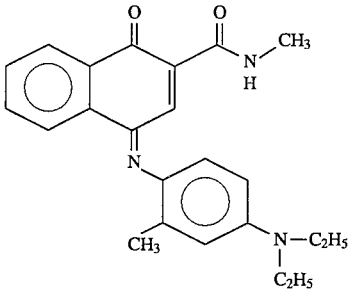
D-16
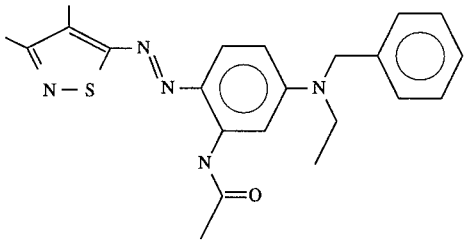
D-17
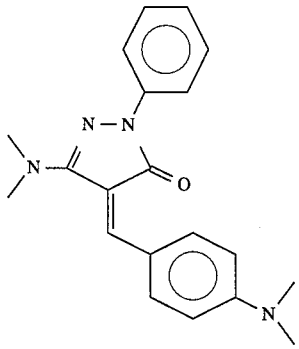

-continued

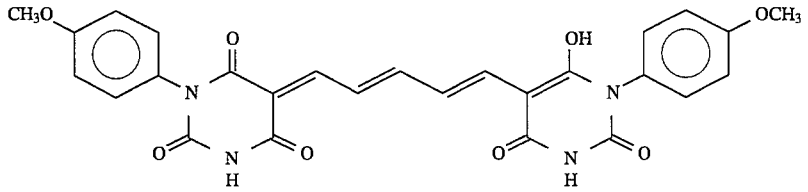

D-18

It is to be understood that this list is representative only, and not meant to be exclusive. In particularly preferred embodiments of the invention, the compound useful in imaging elements is a sensitizing dye, thermal transfer dye or filter dye.

In general, filter dyes that can be used in accordance with this invention are those described in European patent applications EP 549,089 of Texter et al, and EP 430,180 and U.S. Patents Nos. U.S. 4,803,150; U.S. 4,855,221; U.S. 4,857,446; U.S. 4,900,652; U.S. 4,900,653; U.S. 4,940,654; U.S. 4,948,717; U.S. 4,948,718; U.S. 4,950,586; U.S. 4,988,611; U.S. 4,994,356; U.S. 5,098,820; U.S. 5,213,956; U.S. 5,260,179; and U.S. 5,266,454; (the disclosures of which are incorporated herein by reference).

In general, thermal transfer dyes that can be used in accordance with this invention include anthraquinone dyes, e.g., Sumikaron Violet RS® (product of Sumitomo Chemical Co., Ltd.), Dianix Fast Violet 3RFS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumikaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black De (products of Nippon Kayaku Co. Ltd.); acid dyes such as Kayanol Milling Cyanine 5R® (product of Nippon Kayaku Co. Ltd.); basic dyes such as Sumiacryl Blue 6G® (product of Sumitomo Chemical Co., Ltd.), and Aizen Malachite Green® (product of Hodogaya Chemical Co., Ltd.); or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference.

In general, sensitizing dyes that can be used in accordance with this invention include cyanine dyes, merocyanine dyes, complex cyanine dyes, complex merocyanine dyes, homopolar cyanine dyes, hemicyanine dyes, styryl dyes, and hemioxonol dyes. Of these dyes, cyanine dyes, merocyanine dyes and complex merocyanine dyes are particularly useful.

Any conventionally utilized nuclei for cyanine dyes are applicable to these dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei can also be substituted.

The merocyanine dyes and the complex merocyanine dyes that can be employed contain 5- or 6-membered heterocyclic nuclei such as pyrazolin-5-one nucleus, a thiohydantoin nucleus, a 2-thioxazolidin- 2,4-dione nucleus, a thiazolidine-2,4-dione nucleus, a rhodanine nucleus, a thiobarbituric acid nucleus, and the like.

Solid particle dispersions of sensitizing dyes may be added to a silver halide emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. , 3,743,510), cadmium salts, azaindene compounds, and the like, can be present.

The sensitizing dye may be added to an emulsion comprising silver halide grains and, typically, a hydrophilic colloid at any time prior to (e.g., during or after chemical sensitization) or simultaneous with the coating of the emulsion on a photographic support). The dye/silver halide emulsion may be mixed with a dispersion of color image-forming coupler immediately before coating or in advance of coating (for example, 2 hours). The above-described sensitizing dyes can be used individually, or may be used in combination, e.g. to also provide the silver halide with additional sensitivity to wavelengths of light outside that provided by one dye or to supersensitize the silver halide.

The dispersed solid particles preferably have a particle size of less than 0.5 micron, preferably less that about 0.3 micron. In preferred embodiments of the invention the dispersed particles have a particle size of between 0.01 to about 1.0 microns, more preferably 0.01 to 0.5 and most preferably 0.05 to 0.3 micron.

The dispersions of this invention can be used to prepare imaging elements, in particular, photographic elements. In preferred embodiments of this invention, a color photographic element comprises at least one layer comprising a dispersion of this invention. In addition to the dispersion of this invention, the photographic element comprises other components typically used in photographic elements.

The dispersions of the invention can be used in any of the ways and in any of the combinations known in the art. Typically, the invention dispersions are incorporated in a silver halide emulsion and the emulsion coated as a layer on a support to form part of a photographic element.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND.

In the following discussion of suitable materials for use in the dispersions and elements of this invention, reference will be made to *Research Disclosure,* December 1989, Item 308119, available as described above, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the photographic elements of this invention can be either negative-working or positive-working. Suitable emulsions and their preparation as well as methods of chemical and spectral sensitization are described in Sections I through IV. Color materials and development modifiers are described in Sections V and XXI. Vehicles are described in Section IX, and various additives such as brighteners, antifoggants, stabilizers, light absorbing and scattering materials, hardeners, coating aids, plasticizers, lubricants and matting agents are described , for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1, 466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,772,162, 2,895,826, 3,002,836, 3,034,892, 2,474,293, 2,423,730, 2,367,531, 3,041,236, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,600,788, 2,369,489, 2,343,703, 2,311,082, 3,152,896, 3,519,429, 3,062,653, 2,908,573 and "Farbkuppler-eine LiteratureUbersi cht," published in Agfa Mitteilungen, Band III, pp. 126–156 (1961). Preferably such couplers are pyrazolones, pyrazolotriazoles, or pyrazolobenz imidazoles that form magenta dyes upon reaction with oxidized color developing agents.

Couplers that form yellow dyes upon reaction with oxidized and color developing agent are described in such representative patents and publications as: U.S. Pat. Nos. 2,875,057, 2,407,210, 3,265,506, 2,298,443, 3,048,194, 3,447,928 and "Farbkuppler-eine LiteratureUbersicht," published in Agfa Mitteilungen, Band III, pp. 112–126 (1961). Such couplers are typically open chain ketomethylene compounds.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may also be used in association with "wrong" colored couplers (e.g. to adjust levels of interlayer correction) and, in color negative applications, with masking couplers such as those described in EP 213,490; Japanese Published Application 58–172,647; U.S. Pat. No. 2,983,608; German Application DE 2,706,117C; U.K. Patent 1,530,272; Japanese Application A-113935; U.S. Pat. Nos. 4,070,191 and 4,273,861; and German Application DE 2,643,965. The masking couplers may be shifted or blocked.

The invention dispersions may also be used in association with materials that accelerate or otherwise modify the processing steps e.g. of bleaching or fixing to improve the quality of the image. Bleach accelerator releasing couplers such as those described in EP 193,389; EP 301,477; U.S. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non colorforming couplers.

For example, in a color negative element, the dispersions of the invention may replace or supplement the materials of an element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-(( 2-(4-ethoxy-2,5-dioxo-3-(phenylmethyl)-1-imidazolidinyl)-3-(4-methoxyphenyl)-1,3-dioxopropyl)amino)-, dodecyl ester and a slow yellow layer containing the same compound together with "Coupler 2": Propanoic acid, 2-[[5-[[4-[2-[[[2,4-bis (1,1-dimethylpropyl)phenoxy]acetyl]amino]-5-[

(2,2,3,3,4,4,4-heptafluoro-1-oxobutyl) amino]-4-hydroxyphenoxy] -2,3-dihydroxy-6-[(propylamino)carbonyl phenyl]thio]-1,3,4-thiadiazol-2-yl]thio]-, methyl ester and "Coupler 3": 1-((dodecyloxy)carbonyl) ethyl(3-chloro-4-((3-(2-chloro-4-((1-tridecanoylethoxy) carbonyl)anilino)-3-oxo-2-((4)(5)(6)-(phenoxycarbonyl)- 1H-benzotriazol-1-yl-)propanoyl)amino))benzoate;

(3) an interlayer containing fine metallic silver;

(4) a triple-coat magenta pack with a fast magenta layer containing "Coupler 4": Benzamide, 3-((2-(2,4-bis( 1,1-dimethylpropyl)phenoxy)-1-oxobutyl)amino)-N( 4,5-dihydro-5-oxo-1-(2,4,6-trichlorophenyl)-1H-pyrazol- 3-yl) -, "Coupler 5": Benzamide, 3-((2-(2,4-bis (1,1-dimethylpropyl) phenoxy) -1-oxobutyl) amino) -N( 4',5'-dihydro-5'-oxo-1'-(2,4,6-trichlorophenyl) (1,4'-bi- 1H-pyrazol)-3'-yl)-, "Coupler 6": Carbamic acid, (6((( 3-(dodecyloxy)propyl) amino)carbonyl)-5-hydroxy-1-naphthalenyl)-, 2-methylpropyl ester , "Coupler 7": Acetic acid, ((2-((3-(((3-(dodecyloxy)propyl)amino) carbonyl)-4-hydroxy-8-(((2-methylpropoxy)carbonyl) amino)-1-naphthalenyl)oxy)ethyl)thio)-, and "Coupler 8" Benzamide, 3-((2-(2,4-bis(1,1-dimethylpropyl) phenoxy)-1-oxobutyl)amino)-N-(4,5-dihydro-4-((4-methoxyphenyl) azo)-5-oxo-1-(2,4,6-trichlorophenyl)-1H-pyrazol- 3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6-trichlorophenyl)- 4,5-dihydro-5-oxo-1H-pyrazol-3-yl]-2-methyl- 2-propenamide; and "Coupler 10" Tetradecanamide, N-(4-chloro-3-((4-((4-((2,2-dimethyl- 1-oxopropyl)amino)phenyl)azo)-4,5-dihydro-5 -oxo-1-( 2,4,6-trichlorophenyl) -1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino) -3-((4-(2-((3-(((3-(2,4-bis (1,1-dimethylpropyl)phenoxy) propyl)amino)carbonyl)-4-hydroxy- 1-naphthalenyl) oxy)ethoxy)phenyl)azo)-4-hydroxy-, disodium salt; and a slow cyan layer containing Couplers 2 and 6;

(7) an undercoat layer containing Coupler 8; and (8) an antihalation layer.

In a color paper format, the dispersions of the invention may replace or supplement the materials of an element comprising a support bearing the following layers from top to bottom:

(1) one or more overcoats;

(2) a cyan layer containing "Coupler 1": Butanamide, 2-(2,4-bis(1,1-dimethylpropyl)phenoxy)-N-( 3,5-dichloro-2-hydroxy-4-methylphenyl)-, "Coupler 2". Acetamide, 2-(2,4-bis(1,1-dimethylpropyl)phenoxy)-N-( 3,5-dichloro-2-hydroxy-4-, and UV Stabilizers: Phenol, 2-(5-chloro-2H-benzotriazol-2-yl)-4,6-bis(1,1-dimethylethyl)-; Phenol, 2-(2H-benzotriazol-2-yl)-4( 1,1-dimethylethyl)-;Phenol, 2-(2H-benzotriazol-2-yl)- 4-(1,1-dimethylethyl)-6-(1-methylpropyl)-; and Phenol, 2-(2H-benzotriazol-2-yl)-4,6-bis(1,1-dimethylpropyl)- and a poly(t-butylacrylamide) dye stabilizer;

(3) an interlayer;

(4) a magenta layer containing "Coupler 3". Octanamide, 2-[2,4-bis(1,1-dimethylpropyl)phenoxy]-N-[ 2-(7-chloro-6-methyl-1H-pyrazolo[1,5-b][1,2,4]triazol- 2-yl)propyl]- together with 1,1'-Spirobi(1H-indene), 2,2',3,3'-tetrahydro-3,3,3',3'-tetramethyl-5,5',6,6'-tetrapropoxy-;

(5) an interlayer; and (6) a yellow layer containing "Coupler 4": 1-Imidazolidineacetamide, N-(5-((2-(2,4-bis(1,1-dimethylpropyl)phenoxy)- 1-oxobutyl)amino)-2-chlorophenyl)-.alpha.-( 2,2-dimethyl-1-oxopropyl)-4-ethoxy- 2,5-dioxo-3-(phenylmethyl)-.

In a reversal format, the dispersions of the invention may replace or supplement the materials of an element comprising a support bearing the following layers from top to bottom:

(1) one or more overcoat layers;

(2) a nonsensitized silver halide containing layer;

(3) a triple-coat yellow layer pack with a fast yellow layer containing "Coupler 1": Benzoic acid, 4-( 1-(((2-chloro-5-((dodecylsulfonyl)amino)phenyl) amino)carbonyl)-3,3-dimethyl-2-oxobutoxy)-, 1-methylethyl ester; a mid yellow layer containing Coupler 1 and "Coupler 2": Benzoic acid, 4-chloro-3-[ [2-[4-ethoxy-2,5-dioxo-3-(phenylmethyl)-1-imidazolidinyl] -4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast magenta layer containing "Coupler 3": 2-Propenoic acid, butyl ester, polymer with N-[1-(2,5-dichlorophenyl) 4,5-dihydro-5-oxo-1H-pyrazol-3-yl]-2-methyl-2-propenamide; "Coupler 4": Benzamide, 3-((2-(2,4-bis( 1,1-dimethylpropyl)phenoxy)-1-oxobutyl)amino)-N-( 4,5-dihydro-5-oxo-1-(2,4,6-trichlorophenyl)-1H-pyrazol- 3-yl)-; and "Coupler 5": Benzamide, 3-(((2,4bis( 1,1-dimethylpropyl)phenoxy-)acetyl)amino)-N-(4,5-dihydro- 5-oxo-1-(2,4,6-trichlorophenyl)-1H-pyrazol-3-yl)-; and containing the stabilizer 1,1'-Spirobi(1H-indene), 2,2',3,3'-tetrahydro-3,3,3',3'-tetramethyl- 5,5',6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2-cyanophenoxy)-N-( 4-((2,2,3,3,4,4,4-heptafluoro-1-oxobutyl)amino)-3-hydroxyphenyl)-; a mid cyan containing"Coupler 7": Butanamide, N-(4-((2-(2,4-bis( 1,1-dimethylpropyl)phenoxy)-1-oxobutyl)amino)-2-hydroxyphenyl)- 2,2,3,3,4,4,4-heptafluoro- and "Coupler 8": Hexanamide, 2-(2,4-bis(1,1-dimethylpropyl)phenoxy)-N-( 4-((2,2,3,3,4,4,4-heptafluoro-1-oxobutyl)amino)-3-hydroxyphenyl)-;

(10) one or more interlayers possibly including fine-grained nonsensitized silver halide; and

(11) an antihalation layer.

The invention dispersions may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. 4,366,237; EP 96,570; U.S. 4,420,556; and U.S. Pat. No. 4,543,323.) Also, the compositions may be blocked or coated in protected form as described, for example, in Japanese Application 61/258,249 or U.S. Pat. No. 5,019,492.

The invention dispersions may further be used in combination with image-modifying compounds such as "Developer Inhibitor-Releasing" compounds (DIR's). DIR's useful in conjunction with the compositions of the invention are known in the art and examples are described in U.S. Patent Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362, 878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science* and *Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

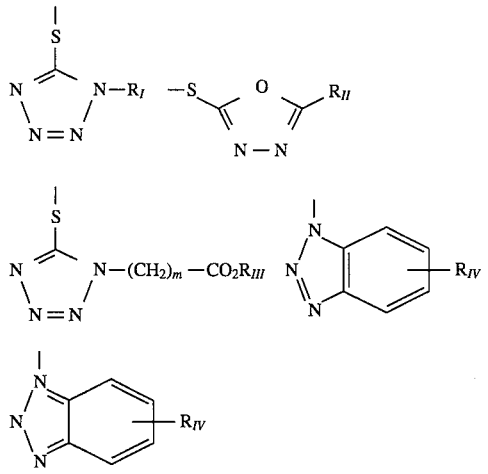

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60- 249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

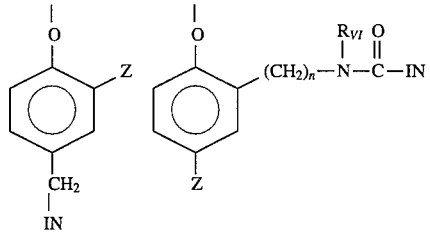

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1
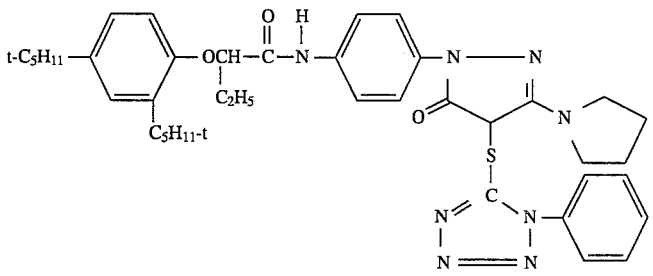
D2
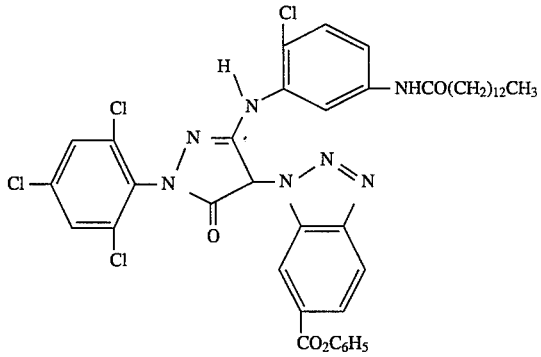
D3
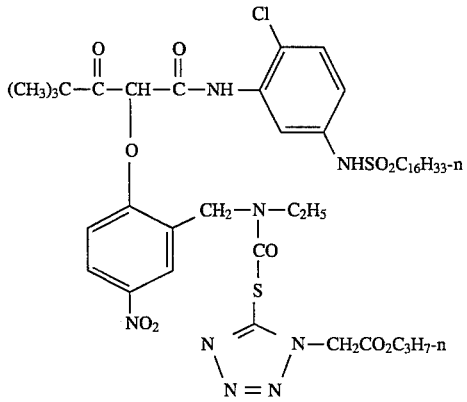
D4
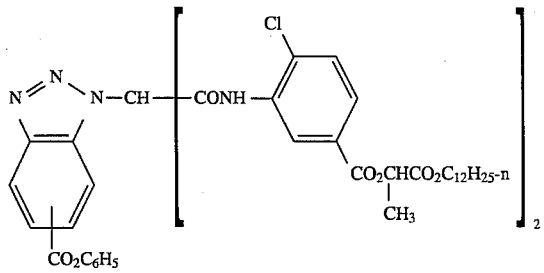
D5
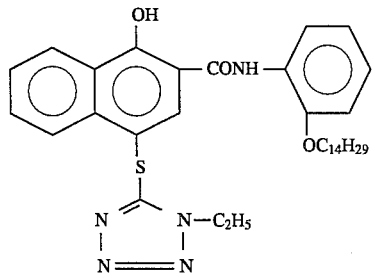

-continued
D6
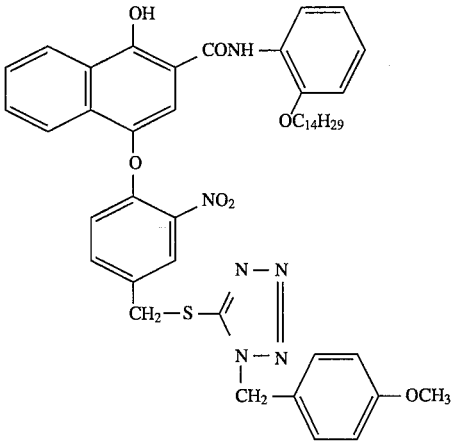
D7
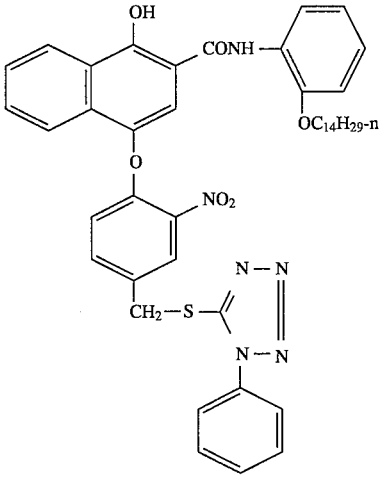
D8
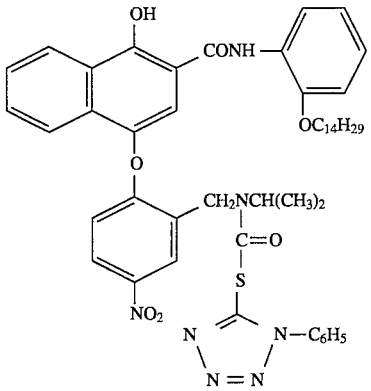

-continued

D9

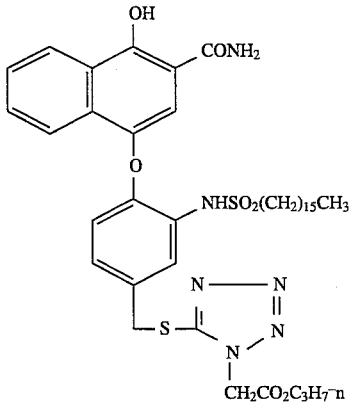

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Dispersions of the invention may be coated on pH adjusted support as described in U.S. Pat. No. 4,917,994; with epoxy solvents (EP 0 164 961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078, 230; 90-079,336; 90-079,337; 90-079,338; 90-079,690; 90-079,691; 90-080,487; 90-080,488; 90-080,489; 90-080, 490; 90-080,491; 90-080,492; 90-080,494; 90-085,928; 90-086,669; 90-086,670; 90-087,360; 90-087,361; 90-087, 362; 90-087,363; 90-087,364; 90-088,097; 90-093,662; 90-093,663; 90-093,664; 90-093,665; 90-093,666; 90-093, 668; 90-094,055; 90-094,056; 90-103,409; 83-62,586; 90-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micron) tabular grains. To achieve the lowest levels of granularity it is preferred that aim tabular grain projected areas be satisfied with ultrathin (t<0.06 micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616. In addition, use of [100] silver chloride emulsions as described in EP 534,395 are specifically contemplated.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198. Where applicable, the element may be processed in accordance with color print processes such a the RA-4 process of Eastman Kodak Company as described in the British Journal of Photography Annual of 1988, Pp 198– 199. To provide a positive (or reversal) image, the color development step can be preceded by development with a non-chromogenic developing agent to develop exposed silver halide, but not form dye, and followed by uniformly fogging the element to render unexposed silver halide developable. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(b-(methanesulfonamido) ethyl)aniline sesquisulfate hydrate, 4-amino-3-methyl-N-ethyl-N-(b-hydroxyethyl)aniline sulfate, 4-amino-3-b-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The following examples illustrate this invention.

EXAMPLE 1

Three separate aqueous premix slurries of a yellow solid particle filter dye, see structural formula below, were prepared by combining the following ingredients with simple mixing:

| Component | Amount (g) |
|---|---|
| Dye | 0.675 |
| Triton X-200 (surfactant) | 0.0675 |
| Polyvinyl pyrolidone (mw = 15,000) | 0.0675 |
| water | 12.69 |
| total | 13.50 |

The dye used has the structural formula:

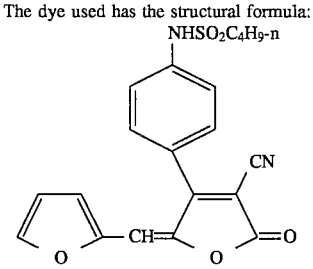

The slurry on the variation of Sample 1-2 (see the following table) was combined with 17.5 g of 450 μm mean diameter polystyrene milling media. The slurry in the variation of Sample 1-3 was combined with 17.5 g of 50 μm mean diameter polystyrene milling media. The slurry in variation Sample 1-1 was held as the control and not milled, whereas variations Sample 1-2 and Sample 1-3 were milled for 100 minutes residence time using a laboratory scale mill at 2300 rpm. The following table summarizes the variations:

| sample | media size (μm) | variation |
|---|---|---|
| 1-1 | no media | unmilled control |
| 1-2 | 450 | conventional size media |
| 1-3 | 50 | invention |

After milling was complete, the slurries were separated from the media using an 8 μm filter. Each slurry was characterized for physical properties including particle size distribution and dye absorption spectra. Particle size was measured by Capillary Hydrodynamic Fractionation (Matec Applied Sciences, 75 House Street, Hopkinton, Mass., 01748) using a high resolution capillary cartridge Serial #208 and eluted with a 10 wt % dilution GR-500 aqueous eluent. Absorbance spectra were measured by Computer-Aided Spectrophotometric System (CASS).

The attached Figures compare the particle size number and weight distributions for each variation. The following table compares the weight average particle diameters for each variation:

| sample | diameter (nm) |
|---|---|
| 1-1 | 147.1 |
| 1-2 | 129.3 |
| 1-3 | 55.0 |

Figure 2:
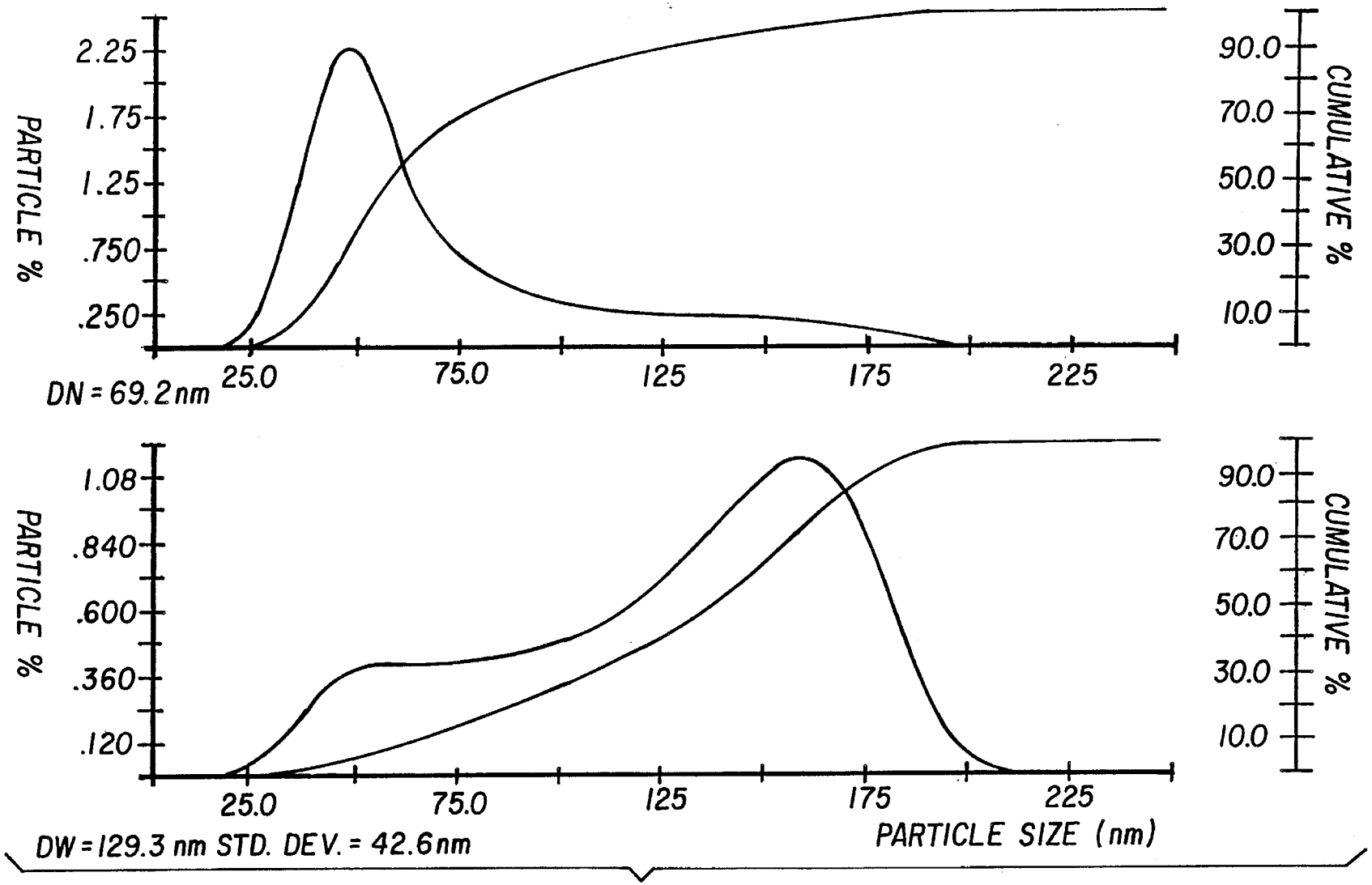
Figure 3:
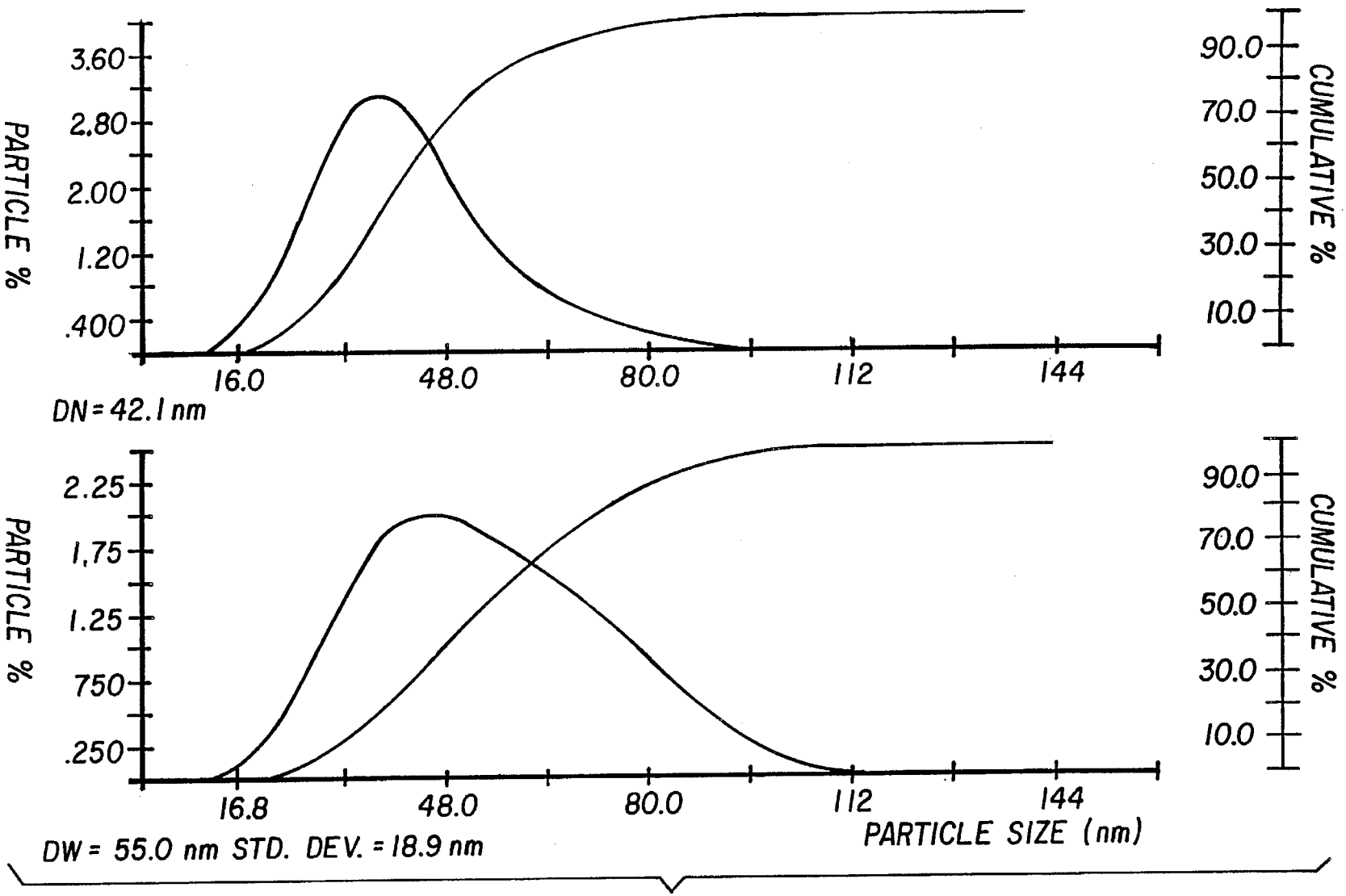

As shown in FIG. 2, milling with the conventional size 450μm media in variation Sample 1-2 results in a slight reduction in particle size relative to the control in FIG. 1. However, milling with 50 μm media in variation Sample 1-3 results in a much greater size reduction and narrower size distribution as shown in FIG. 3.

Figure 4:
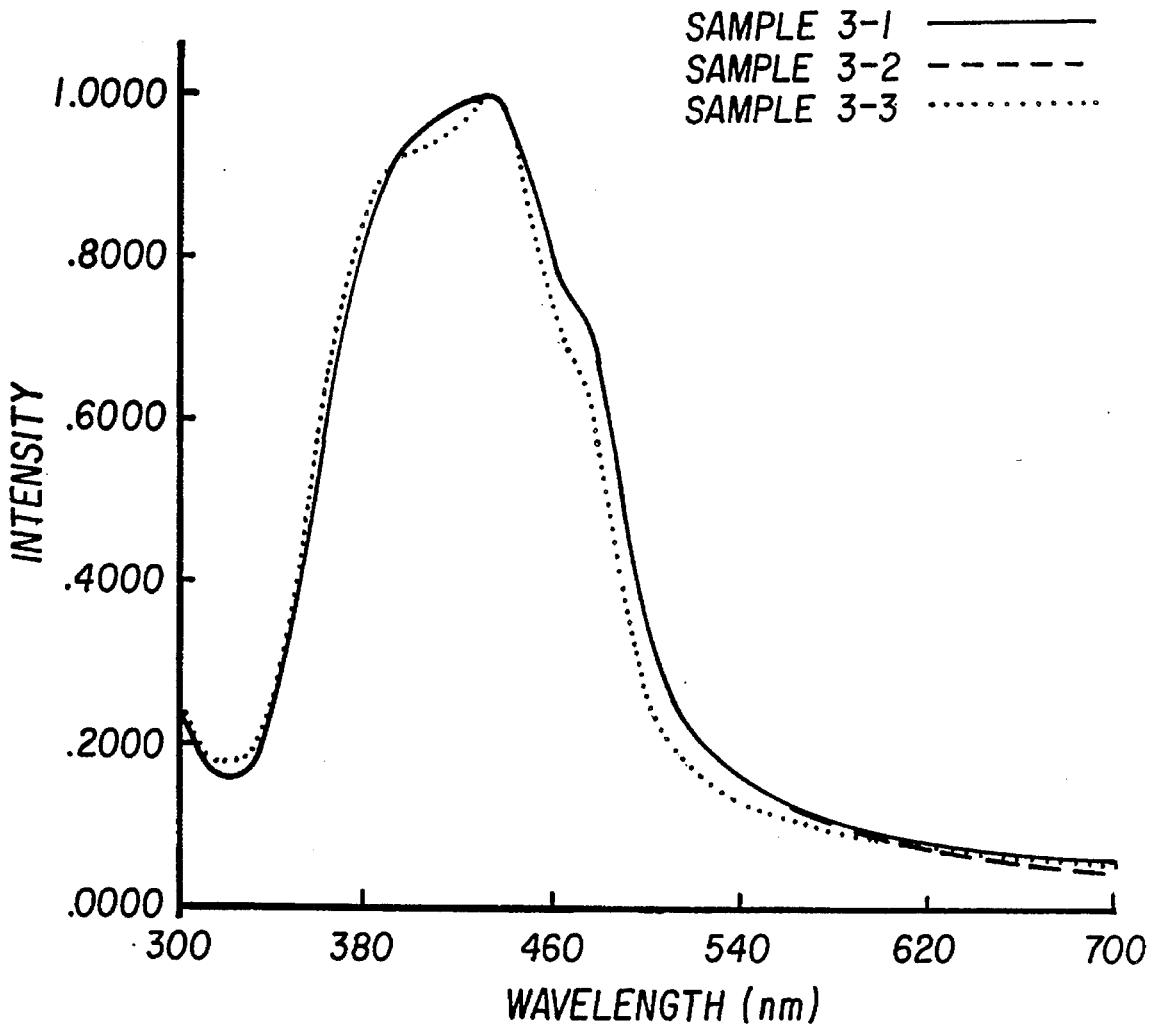

FIG. 4 shows the normalized absorbance spectra for each variation. Variations Sample 1-1 and Sample 1-2 show nearly equivalent spectra, although variation Sample 1-3 shows a more selective spectra with reduced light scattering. Reduced scattering in photographic coatings can result in improved image quality, such as greater sharpness.

The following table compares the molar extinction coefficients at lamda max for each variation:

| sample | E(max) (1/mol*cm) |
|---|---|
| 1-1 | 20868 |
| 1-2 | 20431 |
| 1-3 | 21720 |

Sample 1-3 also shows improved molar extinction, which indicates improved dye covering power. Improved covering power can enable reduced dye laydown and provide cost savings.

EXAMPLE 2

Three separate aqueous premix slurries of a magenta solid particle filter dye, of the structural formula set forth below, were prepared by combining the following ingredients with simple mixing:

| Component | Amount (g) |
|---|---|
| Dye | 0.675 |
| oleoylmethyltaurine (Aerosol OT) | 0.135 |
| water | 12.69 |
| Total | 13.50 |

The dye used has the structural formula:

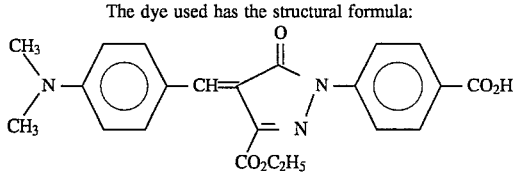

In the same manner as set forth in Example 1, the slurry was combined with 17.5 g of 50 μm mean diameter polystyrene milling media (Sample 2-2) and with 17.5 g of 450 μm mean diameter polystyrene milling media (Sample 2-3) and the control (Sample 2-1) was not milled. Sample 2-2 and Sample 2-3 were milled for 100 minutes residence time using a laboratory mill as in Example 1. The following table summarizes the variations:

| sample | media size (μm) | variation |
|---|---|---|
| Sample 2-1 | no media | unmilled control |
| Sample 2-2 | 50 | invention |
| Sample 2-3 | 450 | conventional size media |

After milling was complete, the slurries were separated from the media using an 8 μm filter. Each slurry was characterized for physical properties as in Example 1.

The accompanying Figures, as discussed below, compare the particle size number and weight distributions for each variation. The following table compares the weight average particle diameters for each variation:

| sample | diameter (nm) |
|---|---|
| 2-1 | 169.0 |
| 2-2 | 94.6 |
| 2-3 | 143.2 |

Figure 5:
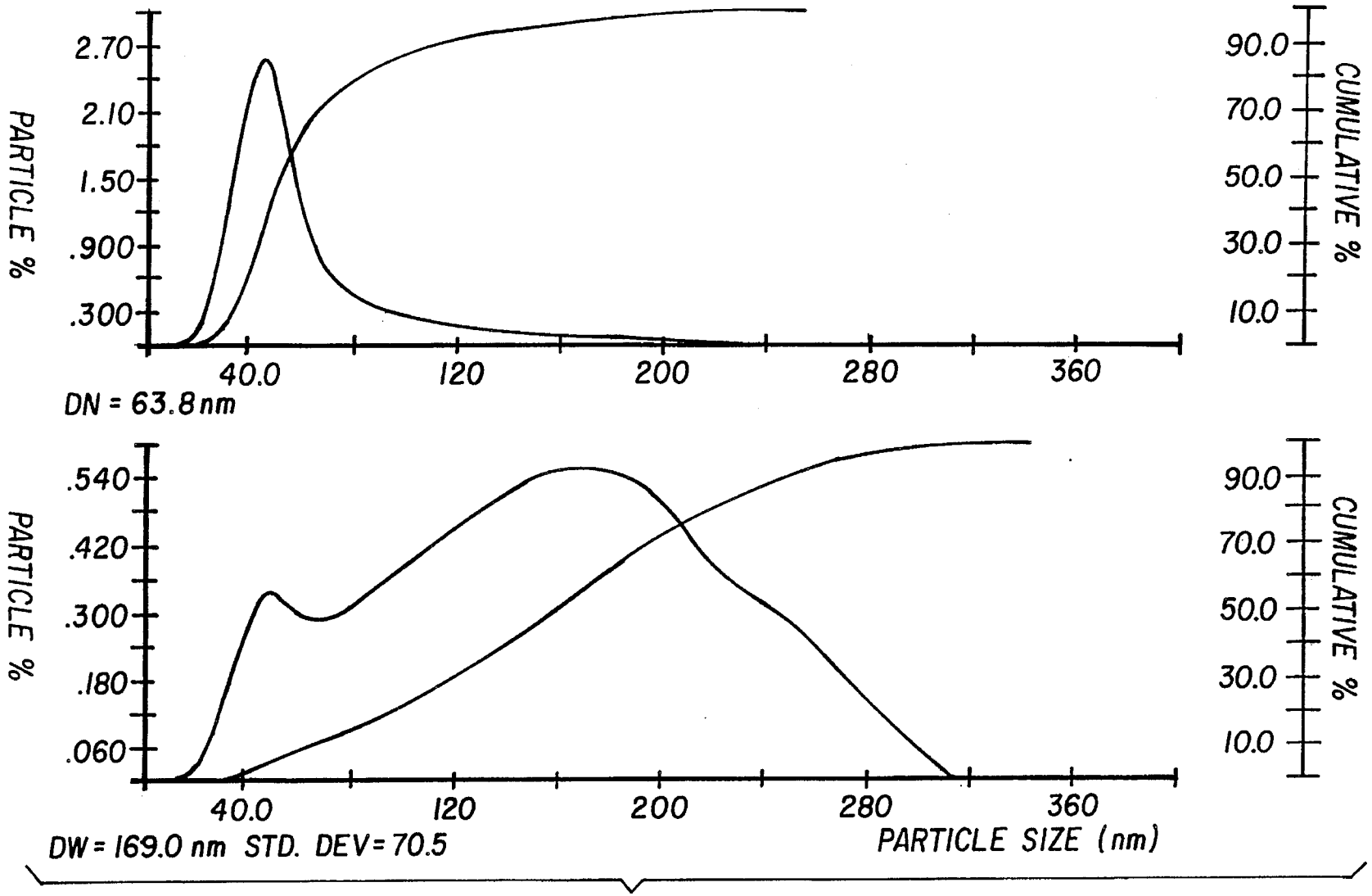
Figure 6:
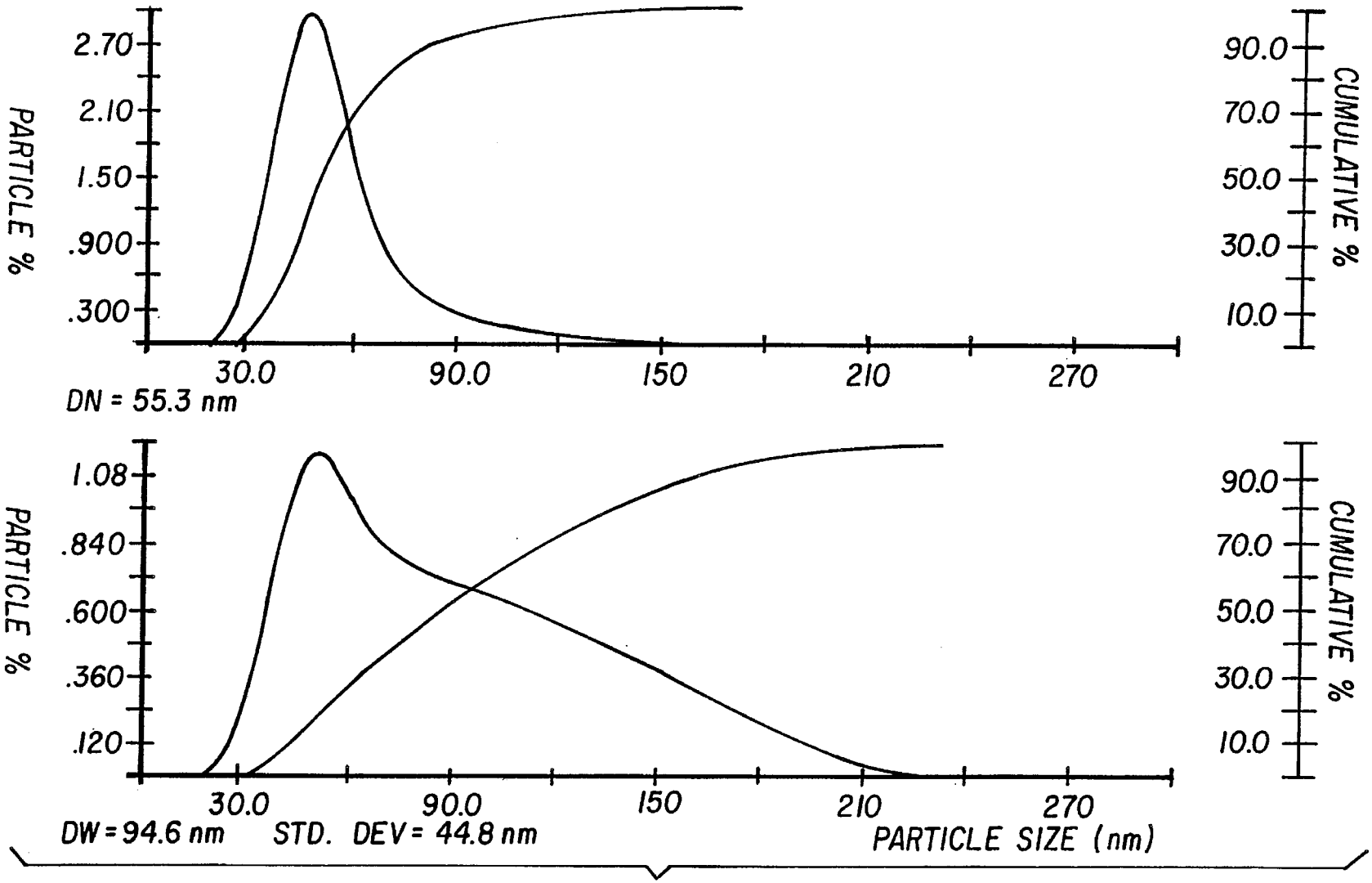
Figure 7:
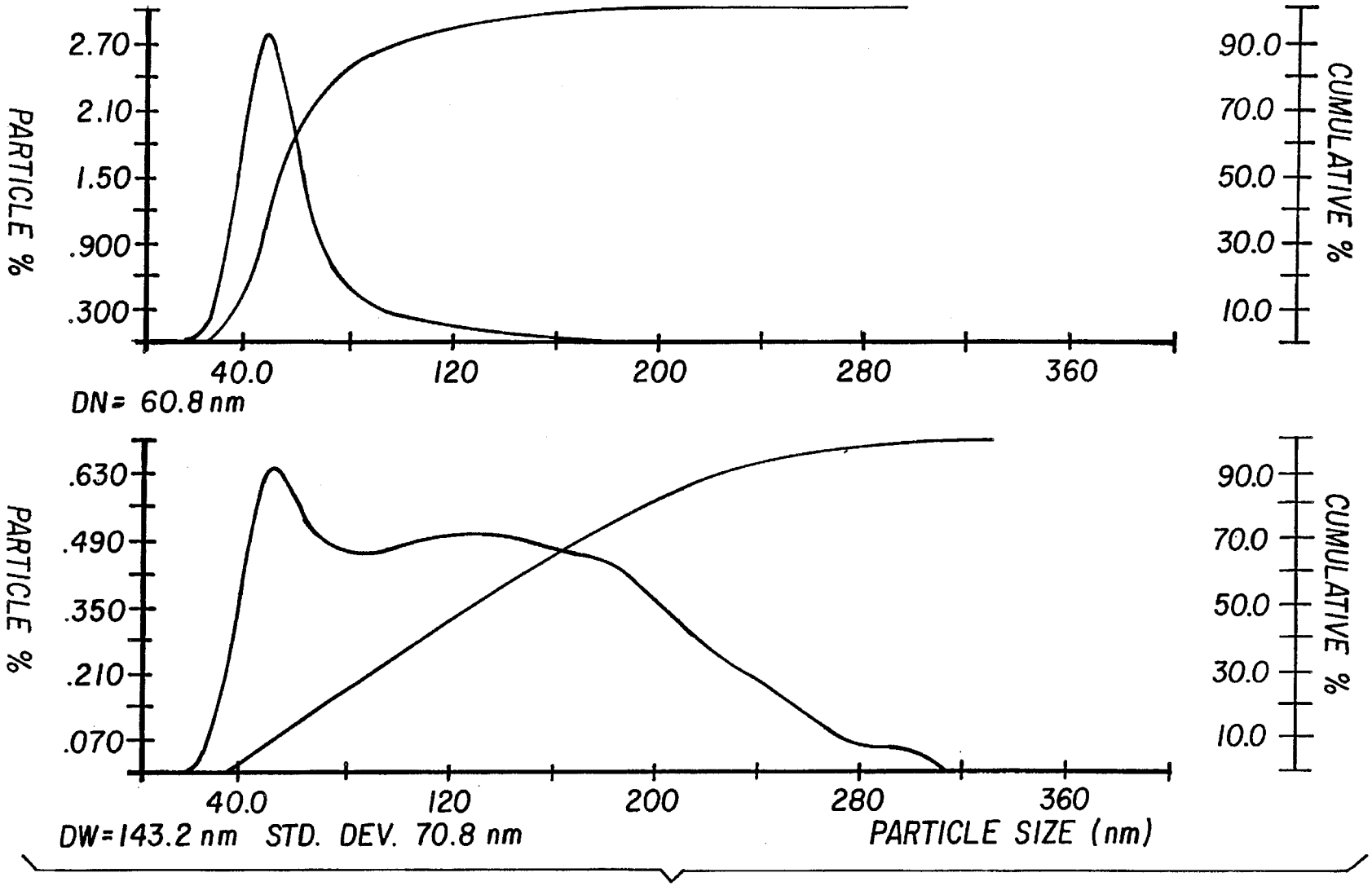

As shown in FIG. 7, milling with the conventional size 450 μm media in variation Sample 2-3 results in a slight reduction in particle size relative to the control in FIG. 5. However, milling with 50 μm media in variation Sample 2-2 results in a much greater size reduction and narrower size distribution as shown in FIG. 6.

Figure 8:
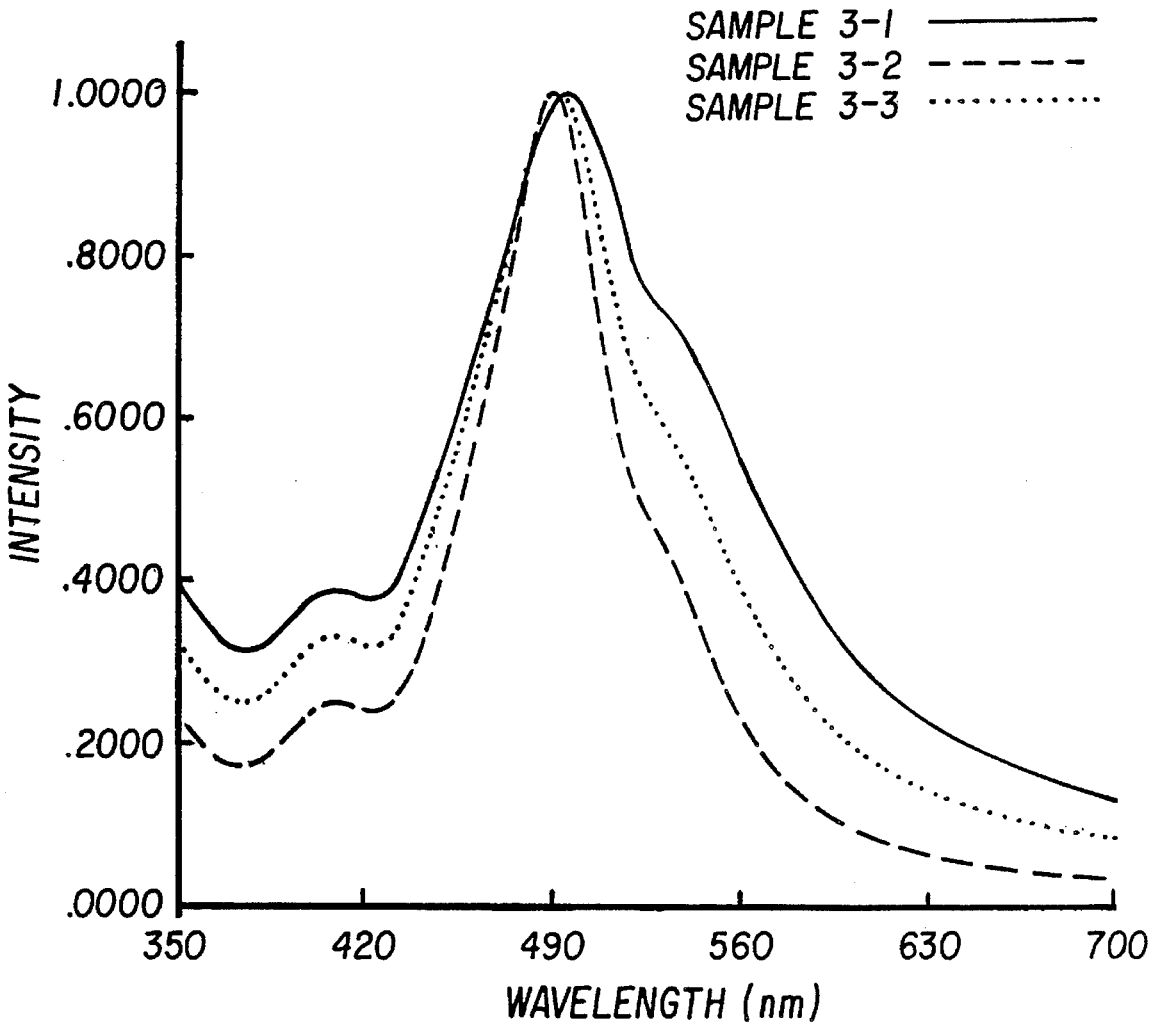

FIG. 8 shows the normalized absorbance spectra for each variation. This figure shows a narrowing of spectral bandwidth which corresponds to a decrease in the average particle diameter. Variation Sample 2-2 using 50 μm milling media results in the narrowest bandwidth and lowest level of light scattering.

The following table compares the molar extinction coefficients at lamda max for each variation:

| Sample | E(max) (l/mol*cm) |
|---|---|
| 2-1 | 38363 |
| 2-2 | 74994 |
| 2-3 | 57375 |

Again, variation Sample 2-2 using 50 μm media shows improved molar extinction relative to the other variations.

EXAMPLE 3

Six separate aqueous premix slurries of a yellow solid particle filter dye, of the structural formula set forth below, were prepared by combining the following ingredients with simple mixing:

| Component | Amount (g) |
|---|---|
| Dye | 0.675 |
| Oleoylmethyltaurine, sodium salt | 0.135 |
| water | 12.69 |
| Total | 13.50 |

The dye used has the structural formula:

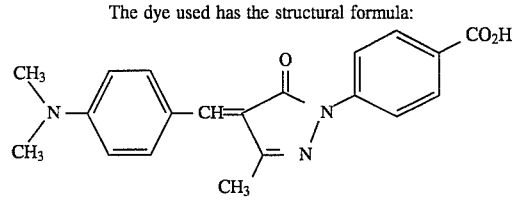

The slurry variation 3-2 was combined with 17.5 g of 50 μm mean diameter polystyrene milling media. The slurry variation 3-3 was combined 17.5 g of 450 μm mean diameter polystyrene milling media. The slurry in variation 3-1 was held as the control and not milled whereas variations 3-2 and 3-3 were milled for 100 minutes residence time using a laboratory high energy attritor mill as in Example 1. The following table summarizes the variations:

| sample | media size (μm) | variation |
|---|---|---|
| 3-1 | no media | unmilled control |
| 3-2 | 50 | invention |
| 3-3 | 450 | conventional size media |
| 3-4 | 5 | invention |
| 3-5 | 25 | invention |
| 3-6 | 75 | invention |

After milling was complete, the slurries were separated from the media using an 8 μm filter. Each slurry was characterized for physical properties as in Example 1.

The accompanying Figures compare the particle size number and weight distributions for each variation. The following table compares the weight average particle diameters for each variation:

| Sample | diameter (nm) |
|---|---|
| 3-1 | 92.4 |
| 3-2 | 56.5 |
| 3-3 | 80.6 |

-continued

| Sample | diameter (nm) |
|---|---|
| 3-4 | 86.4 |
| 3-5 | 90.2 |
| 3-6 | 63.7 |

Figure 9:
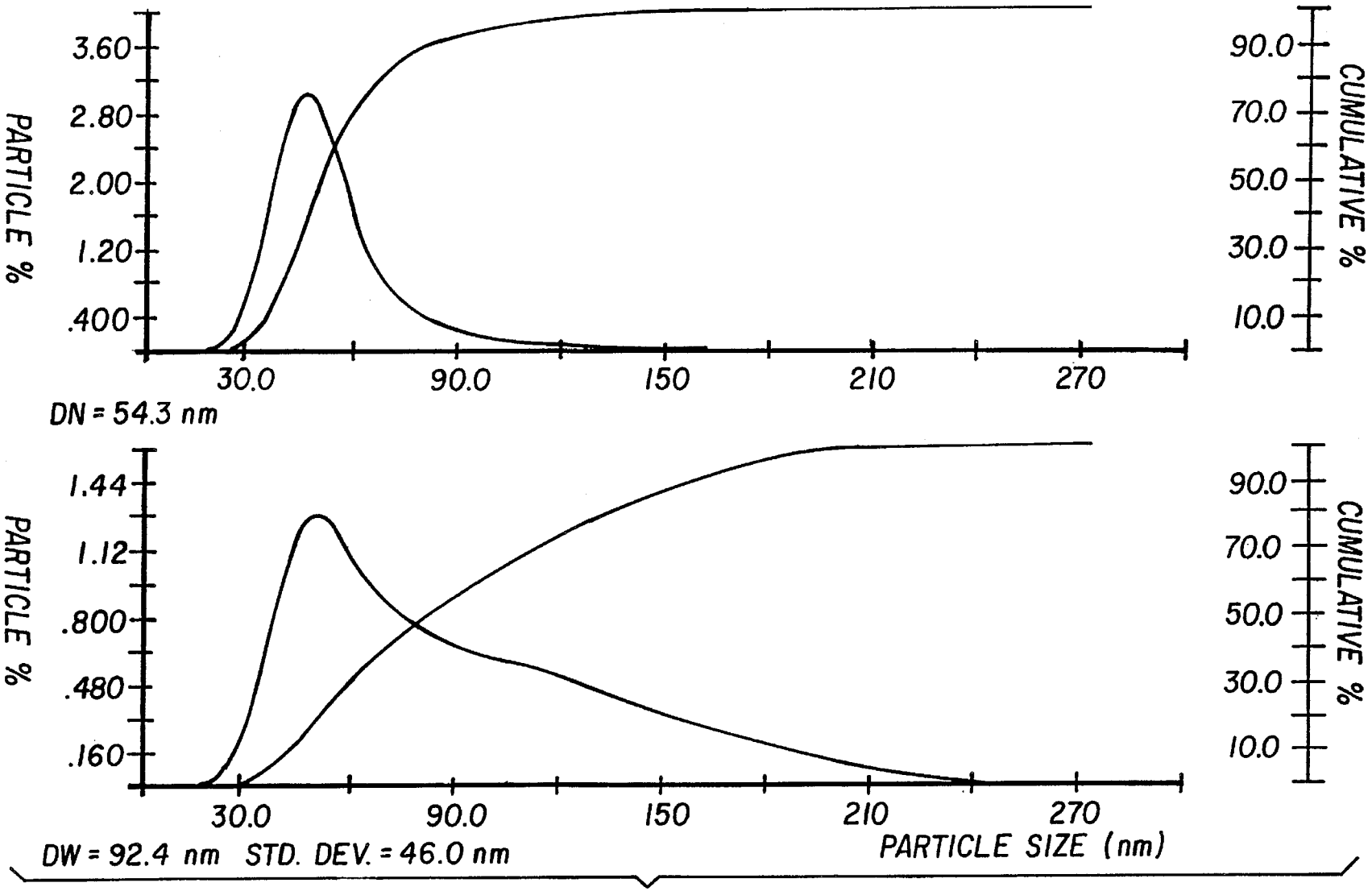
Figure 10:
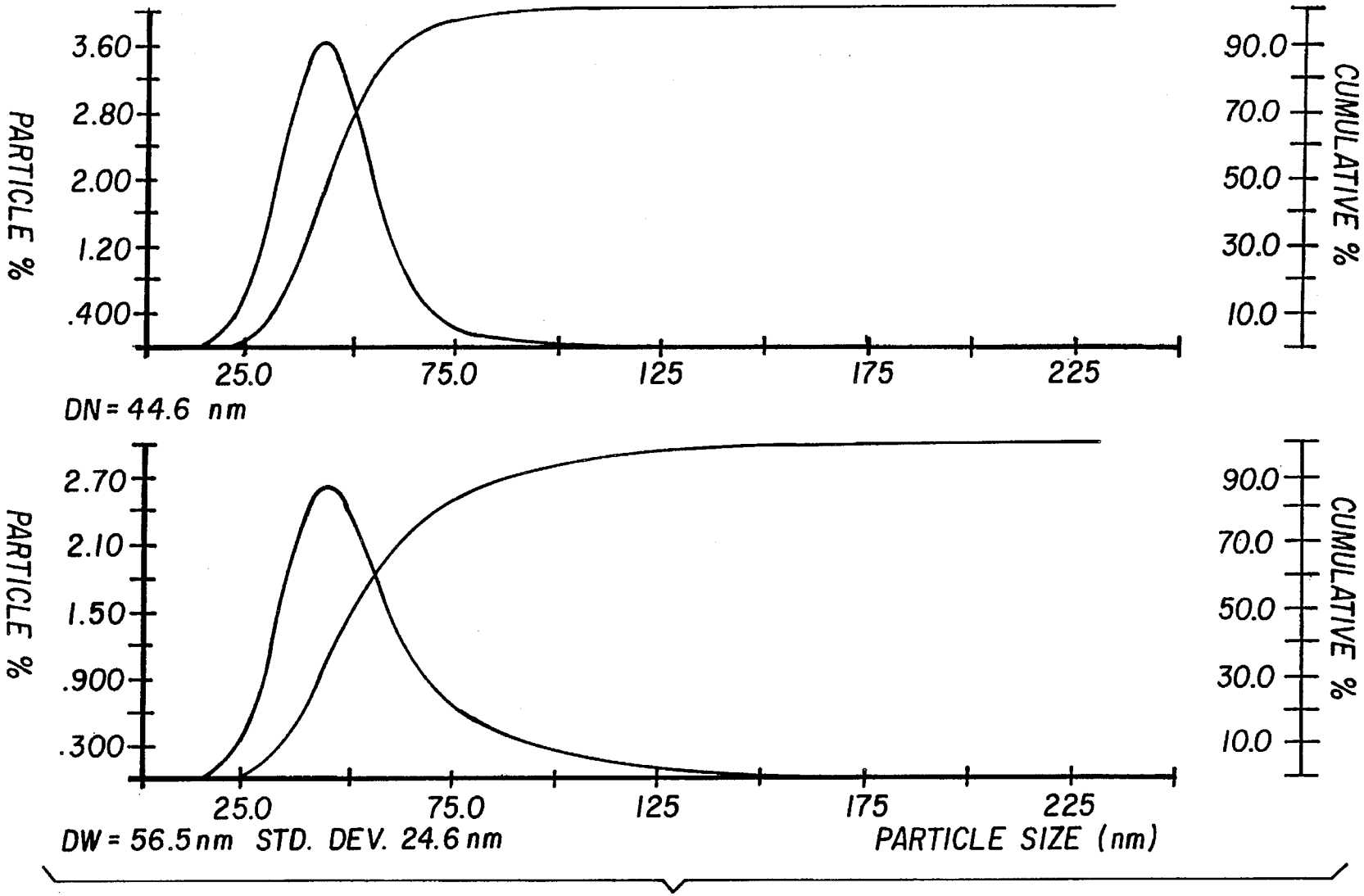
Figure 11:
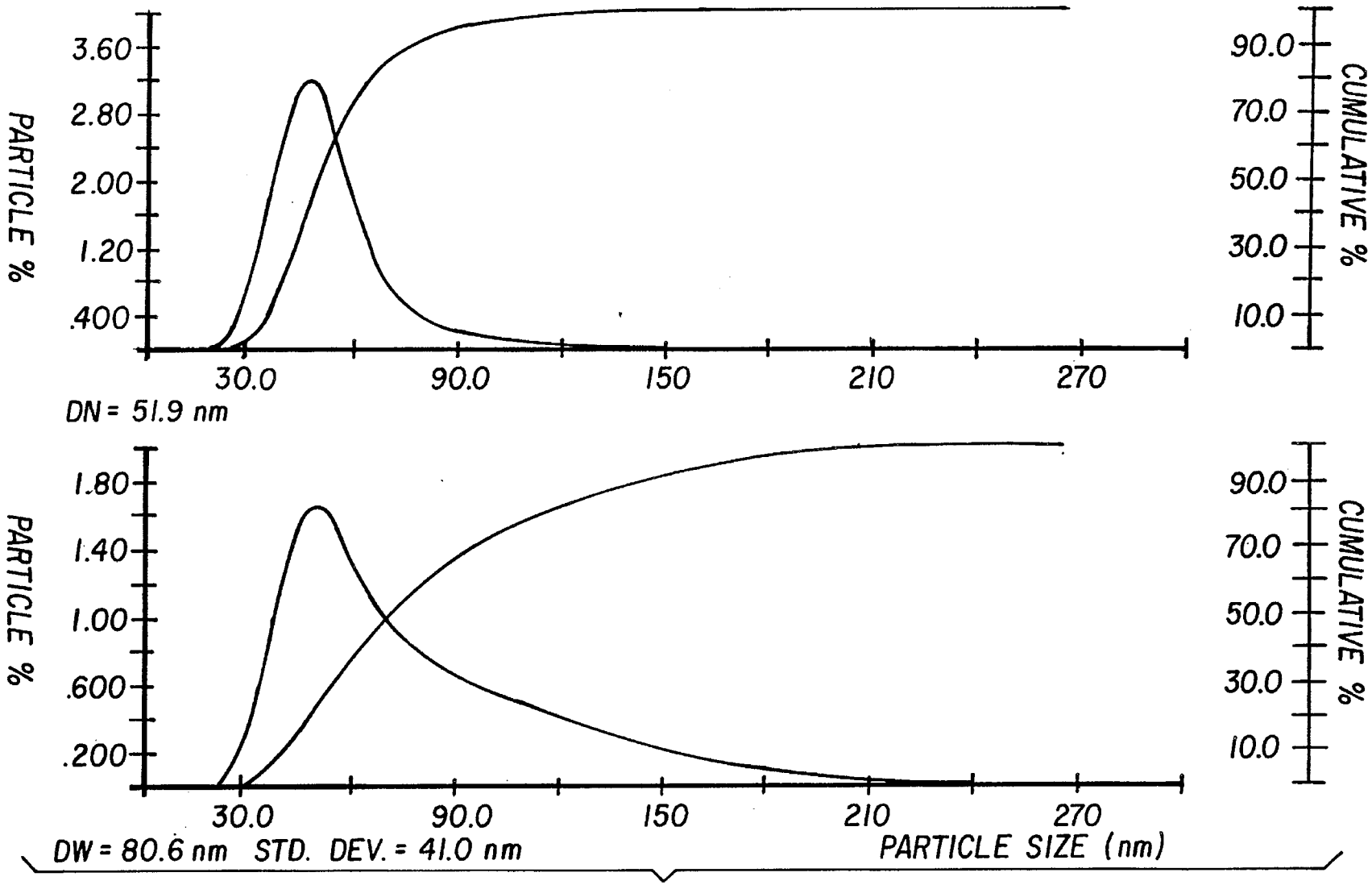
Figure 12:
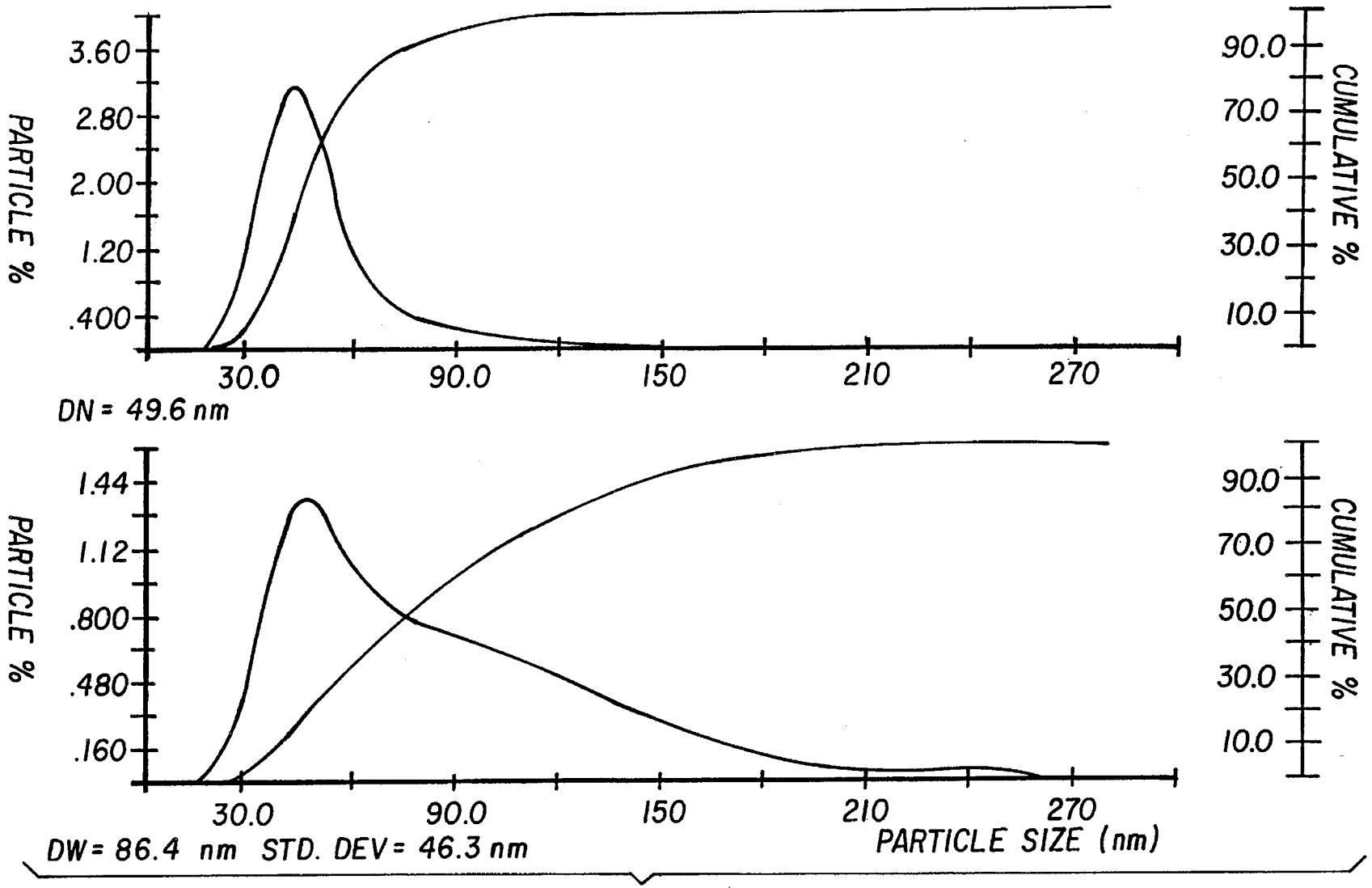
Figure 13:
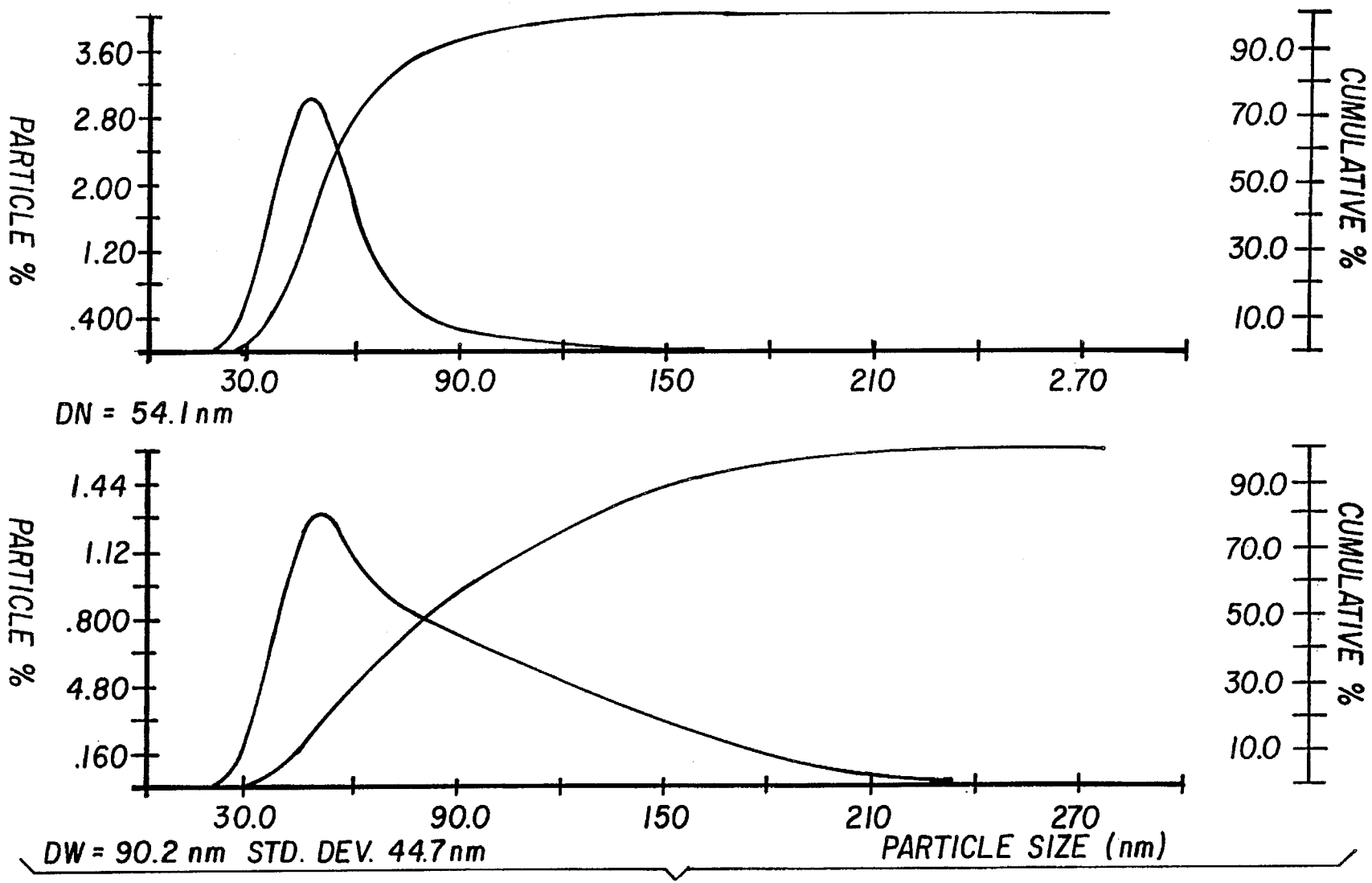
Figure 14:
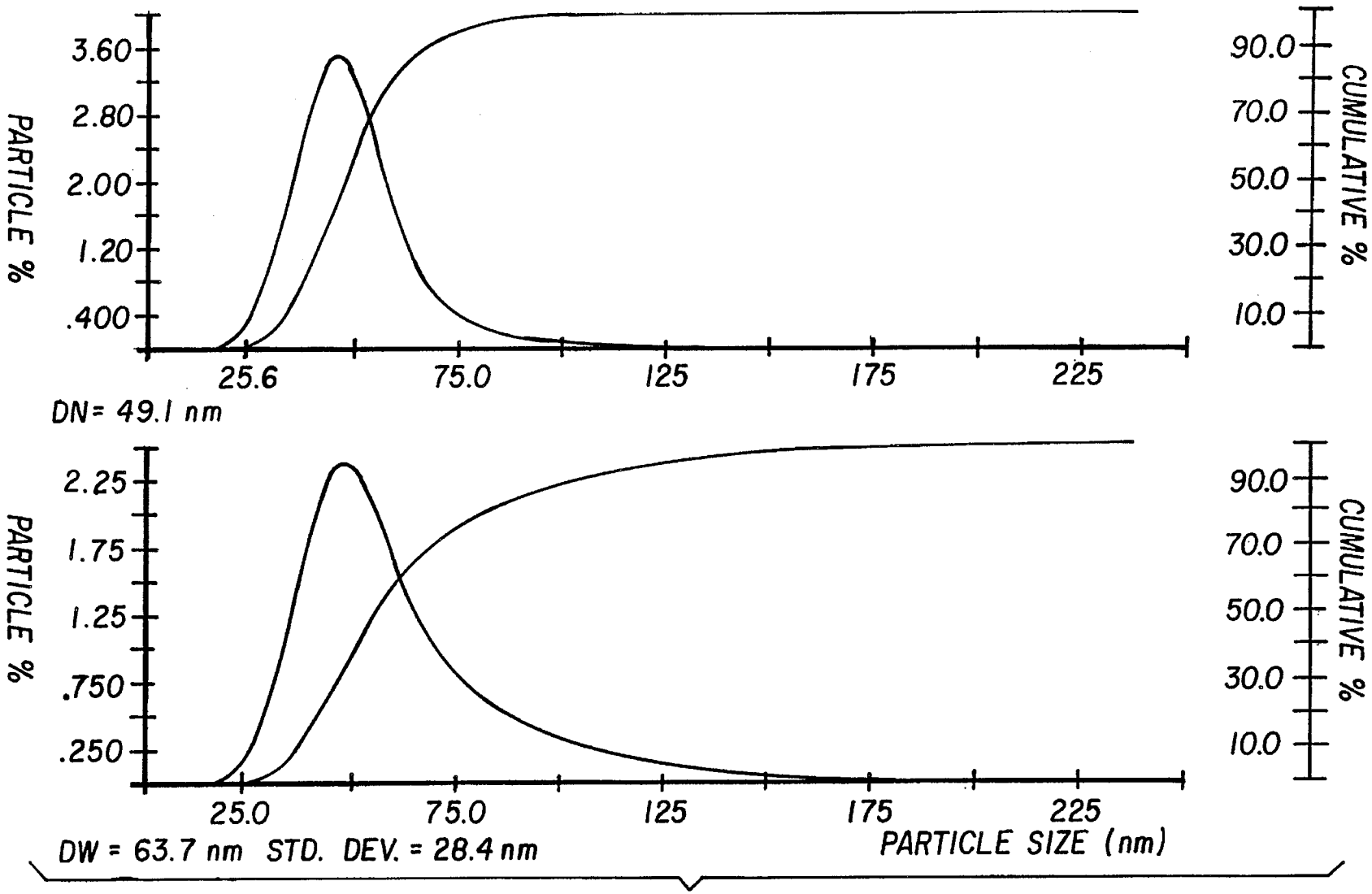

As shown in FIG. 11, milling with the conventional size 450 μm media in variation Sample 3-3 results in a slight reduction in particle size relative to the control in FIG. 9. However, milling with 50μm and 75 μm media in variations Sample 3-2 and Sample 3-6) results in much greater size reduction and narrower size distributions, as shown in FIGS. 10 and 14. Variations Sample 3-4 and Sample 3-5 using 5 μm and 25 μm media, respectively result in smaller size than the control, as shown in FIGS. 12 and 13.

Figure 15:
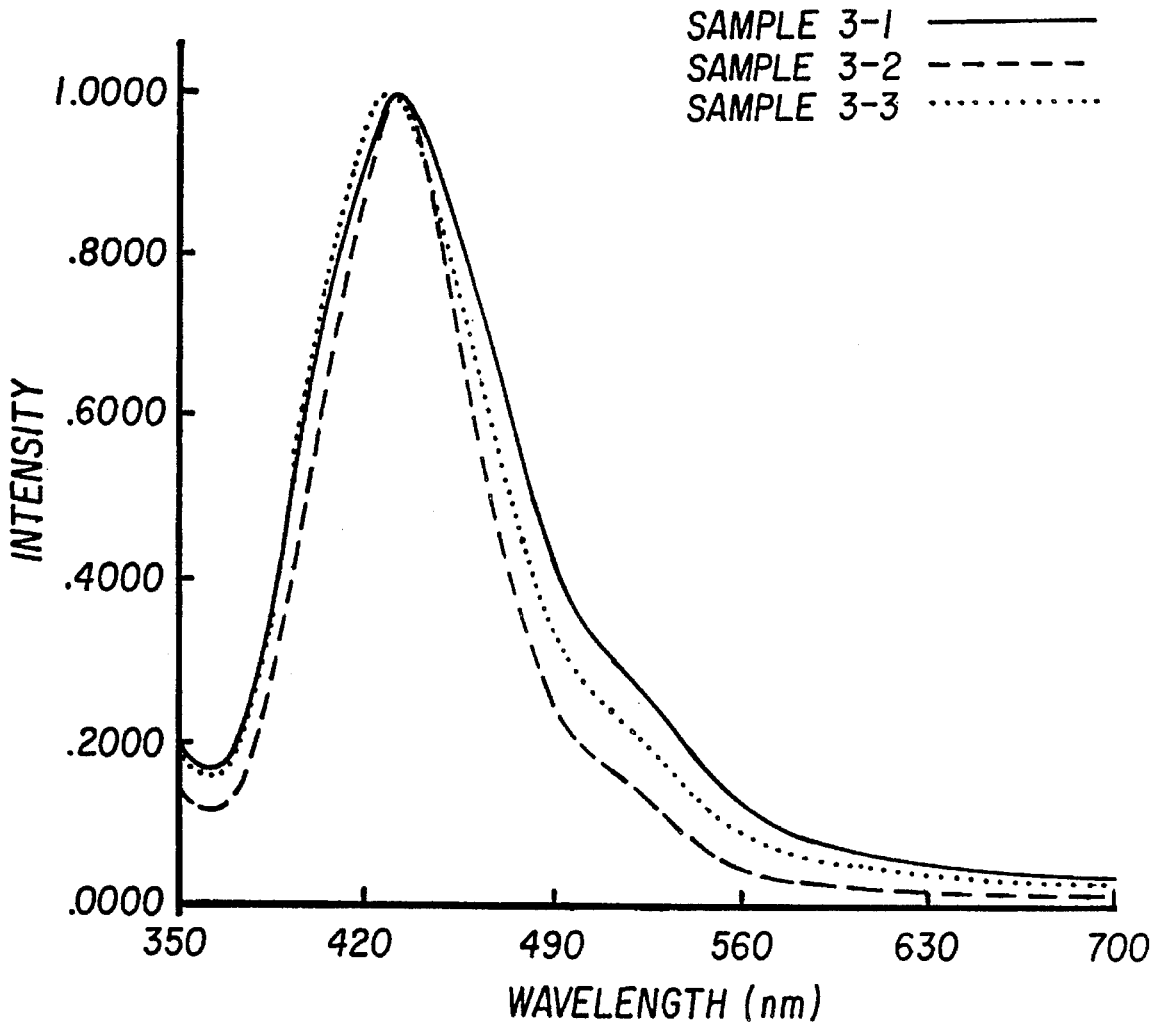

FIG. 15 shows the normalized absorbance spectra for variations Samples 3-1, 3-2 and 3-3). As in the previous examples, this figure shows a narrowing of spectral bandwidth which corresponds to a decrease in the average particle diameter. Variation Sample 3-2 using 50 μm milling media results in the narrowest bandwidth and lowest level of light scattering.

The following table compares the molar extinction coefficients at lamda max for each variation:

| Sample | E(max) (1/mol*cm) |
|---|---|
| 3-1 | 29043 |
| 3-2 | 38583 |
| 3-3 | 31941 |
| 3-4 | 30638 |
| 3-5 | 31458 |
| 3-6 | 37622 |

All variations show improved molar extinction relative to the control. Variations using 50 μm and 75 μm media show particularly larger increases relative to the variation using conventional 450 μm media.

The invention has been described in detail with particular reference to certain preferred embodiments thereof, but it will be understood that variations and modifications can be effected within the spirit and scope of the invention.

What is claimed is:

1. A method of preparing submicron particles of a compound useful in imaging elements in the presence of rigid milling media having a mean particle size of less than 100 microns.

2. The method of claim 1, wherein said media is a polymeric resin.

3. The method of claim 1, wherein said media have a mean particle size of less than 75 microns.

4. The method of claim 1, wherein said media have an average size of about 50 microns.

5. The method of claim 1, wherein said milling media comprises polystyrene crosslinked with divinyl benzene.

6. The method of claim 1, wherein said milling media comprises polymethylmethacrylate.

7. The method of claim 1, wherein said method is a wet milling process.

8. The method of claim 1, wherein said milling takes place in a mill selected from an airjet mill, a roller mill, a ball mill, an attritor mill, a vibratory mill, a planetary mill, a sand mill and a bead mill.

9. The method of claim 1, wherein the compound useful in imaging elements is selected from the group consisting of dye-forming couplers, development inhibitor release couplers (DIR's), development inhibitor anchimeric release couplers (DI(A)R's), masking couplers, filter dyes, optical brighteners, nucleators, development accelerators, oxidized developer scavengers, ultraviolet radiation absorbing compounds, sensitizing dyes, development inhibitors, antifoggants, bleach accelerators, magnetic particles, lubricants, and matting agents.

10. A dispersion for use in the preparation of an imaging element comprising a liquid medium having dispersed therein solid particles of a compound useful in imaging elements having an average particle diameter of less than 100 nm milled in accordance with claim 1.

11. An imaging element comprising a support having thereon at least one dispersion according to claim 10.

* * * * *